US010844538B2

(12) United States Patent
Lee

(10) Patent No.: US 10,844,538 B2
(45) Date of Patent: Nov. 24, 2020

(54) BLEACHING AND SHIVE REDUCTION PROCESS FOR NON-WOOD FIBERS

(71) Applicant: GPCP IP Holdings LLC

(72) Inventor: Jeffrey A. Lee, Neenah, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 497 days.

(21) Appl. No.: 14/716,153

(22) Filed: May 19, 2015

(65) Prior Publication Data

US 2015/0337496 A1 Nov. 26, 2015

Related U.S. Application Data

(60) Provisional application No. 62/000,825, filed on May 20, 2014.

(51) Int. Cl.
*D21C 9/16* (2006.01)
*D21C 9/147* (2006.01)
(Continued)

(52) U.S. Cl.
CPC ..... *D21C 9/163* (2013.01); *A47L 13/16* (2013.01); *A47L 13/17* (2013.01); *D04H 1/425* (2013.01); *D04H 1/4266* (2013.01); *D04H 1/492* (2013.01); *D04H 1/56* (2013.01); *D04H 3/015* (2013.01); *D04H 3/11* (2013.01); *D04H 3/16* (2013.01); *D06B 1/00* (2013.01); *D06L 4/13* (2017.01); *D06L 4/30* (2017.01); *D21C 5/00* (2013.01); *D21C 9/147* (2013.01); *D21C 9/16* (2013.01); *D21C 9/166* (2013.01); *D21H 11/12* (2013.01); *D21H 17/67* (2013.01); *D21H 17/675* (2013.01); *D21H 21/30* (2013.01); *D21H 21/32* (2013.01); *D21H 27/00* (2013.01);
(Continued)

(58) Field of Classification Search
CPC ..... D21C 9/16; D21C 9/08
See application file for complete search history.

(56) References Cited

U.S. PATENT DOCUMENTS 797,749 A 8/1905 Robinson et al.
1,868,513 A 7/1932 Ainslie
(Continued)

FOREIGN PATENT DOCUMENTS

CA 841938 A 5/1970
CA 2745606 A1 7/2010
(Continued)

OTHER PUBLICATIONS

Ahmed et al., Biomechanical Pulping of Kenaf, 1999, TAPPI Pulping Conference, 285-290.*
(Continued)

*Primary Examiner* — Anthony Calandra

(57) ABSTRACT

The present invention is directed to a method of increasing the brightness of non-wood fibers and nonwoven fabric fabrics produced by the method. In one aspect, the method includes forming a mixture of non-wood fibers and exposing the mixture to a brightening agent to produce brightened fibers. The brightening agent is oxygen gas, peracetic acid, a peroxide compound, or a combination thereof. The brightened fibers have a brightness greater than the fibers of the mixture before exposure as measured by MacBeth UV-C standard.

48 Claims, 13 Drawing Sheets

(51) Int. Cl.

| | |
|---|---|
| ***D21H 27/00*** | (2006.01) |
| ***D21H 21/32*** | (2006.01) |
| ***D21H 17/67*** | (2006.01) |
| ***D21H 11/12*** | (2006.01) |
| ***D04H 1/492*** | (2012.01) |
| ***D04H 1/56*** | (2006.01) |
| ***D04H 3/015*** | (2012.01) |
| ***D04H 3/11*** | (2012.01) |
| ***D04H 3/16*** | (2006.01) |
| ***A47L 13/16*** | (2006.01) |
| ***A47L 13/17*** | (2006.01) |
| ***D06B 1/00*** | (2006.01) |
| ***D04H 1/425*** | (2012.01) |
| ***D04H 1/4266*** | (2012.01) |
| ***D06L 4/30*** | (2017.01) |
| ***D21H 21/30*** | (2006.01) |
| ***D21C 5/00*** | (2006.01) |
| ***D06L 4/13*** | (2017.01) |

(52) U.S. Cl.

CPC ..... *D21H 27/004* (2013.01); *D10B 2201/01* (2013.01); *D10B 2201/02* (2013.01); *D10B 2201/04* (2013.01); *D10B 2201/06* (2013.01); *D10B 2201/08* (2013.01); *Y10T 442/60* (2015.04)

(56) References Cited

U.S. PATENT DOCUMENTS

| | | | | |
|---|---|---|---|---|
| 1,908,481 | A * | 5/1933 | Kauffmann | D06L 4/23 8/109 |
| 2,018,276 | A | 10/1935 | McKee | |
| 2,073,682 | A | 3/1937 | Chesley, Jr. | |
| 2,174,178 | A * | 9/1939 | Nichols | D06B 5/00 137/505 |
| 2,267,718 | A | 12/1941 | Campbell et al. | |
| 2,407,227 | A | 11/1943 | Earle | |
| 2,469,249 | A | 5/1949 | Vincent et al. | |
| 3,193,445 | A | 7/1965 | Parker et al. | |
| 3,384,444 | A | 5/1968 | Simpson et al. | |
| 3,472,609 | A | 10/1969 | Panto et al. | |
| 3,485,706 | A | 12/1969 | Evans | |
| 3,661,699 | A | 5/1972 | Farley | |
| 3,775,055 | A | 11/1973 | Wedler | |
| 4,014,635 | A | 3/1977 | Kroyer | |
| 4,033,811 | A | 7/1977 | Gloersen | |
| 4,363,697 | A | 12/1982 | Markham et al. | |
| 4,416,548 | A | 11/1983 | Carre et al. | |
| 4,640,810 | A | 2/1987 | Laursen et al. | |
| 4,756,798 | A * | 7/1988 | Lachenal | D21C 9/1057 162/24 |
| 4,795,476 | A | 1/1989 | Bean et al. | |
| 5,205,835 | A | 4/1993 | Tieckelmann et al. | |
| 5,244,466 | A | 9/1993 | Litz et al. | |
| 5,409,570 | A * | 4/1995 | Griggs | B01F 7/00141 162/40 |
| 5,589,032 | A * | 12/1996 | Chang | C01B 15/06 162/76 |
| 5,683,794 | A * | 11/1997 | Wadsworth | B32B 5/26 442/382 |
| 5,695,868 | A | 12/1997 | McCormack | |
| 5,888,352 | A | 3/1999 | Yoshikawa et al. | |
| 5,958,186 | A | 9/1999 | Holm et al. | |
| 6,083,739 | A | 7/2000 | Franks | |
| 6,136,041 | A | 10/2000 | Jaschinski et al. | |
| 6,258,207 | B1 * | 7/2001 | Pan | D21C 1/04 162/27 |
| 6,302,997 | B1 | 10/2001 | Hurter et al. | |
| 6,514,380 | B1 | 2/2003 | Laine et al. | |
| 6,524,348 | B1 | 2/2003 | Jewell et al. | |
| 6,569,286 | B1 | 5/2003 | Withenshaw et al. | |
| 7,044,985 | B2 | 5/2006 | Rizzardi et al. | |
| 7,481,843 | B2 | 1/2009 | Xu | |
| 7,932,196 | B2 | 4/2011 | McCormack et al. | |
| 8,591,701 | B2 | 11/2013 | Sung et al. | |
| 8,603,802 | B2 | 12/2013 | Sung et al. | |
| 2002/0098317 | A1 | 7/2002 | Jaschinski et al. | |
| 2002/0155281 | A1 | 10/2002 | Lang et al. | |
| 2003/0226209 | A1 | 12/2003 | Fuminori | |
| 2004/0121158 | A1 | 6/2004 | Shannon et al. | |
| 2004/0163779 | A1 | 8/2004 | Pan | |
| 2004/0256065 | A1 | 12/2004 | Ahmed et al. | |
| 2006/0183816 | A1 | 8/2006 | Gelman et al. | |
| 2007/0272378 | A1 * | 11/2007 | Paren | D21C 9/08 162/78 |
| 2008/0087390 | A1 * | 4/2008 | Lee | D21C 9/1057 162/4 |
| 2010/0139877 | A1 | 6/2010 | Black et al. | |
| 2011/0114273 | A1 * | 5/2011 | Yagoob | D21C 3/222 162/23 |
| 2013/0276246 | A1 | 10/2013 | Bellini | |
| 2014/0066872 | A1 | 3/2014 | Baer et al. | |
| 2015/0337486 | A1 | 11/2015 | Lee et al. | |

FOREIGN PATENT DOCUMENTS

| | | | | |
|---|---|---|---|---|
| CN | 86103060 | A | 4/1987 | |
| CN | 1072746 | A | 6/1993 | |
| CN | 1273617 | A | 11/2000 | |
| CN | 1355338 | A | 6/2002 | |
| CN | 101215776 | A | 7/2008 | |
| CN | 101591866 | A * | 12/2009 | |
| CN | 102086533 | A | 6/2011 | |
| CN | 103243599 | A | 8/2013 | |
| CN | 103255661 | A | 8/2013 | |
| CN | 103266519 | A | 8/2013 | |
| DE | 10114341 | A1 | 10/2002 | |
| EP | 0030158 | A1 | 6/1981 | |
| EP | 0206560 | A2 | 12/1986 | |
| EP | 0408199 | A1 | 1/1991 | |
| EP | 0526383 | A1 | 3/1993 | |
| EP | 931862 | A1 | 7/1999 | |
| EP | 1350456 | A1 | 10/2003 | |
| EP | 1780316 | A2 | 2/2007 | |
| EP | 1780316 | A2 | 5/2007 | |
| GB | 412470 | A | 6/1934 | |
| JP | 2002363878 | A | 12/2002 | |
| JP | 2008013859 | A | 1/2008 | |
| JP | 2009020856 | A | 1/2009 | |
| WO | WO-8905882 | A1 * | 6/1989 | D06L 4/10 |
| WO | 9710100 | A1 | 3/1997 | |
| WO | 9826808 | A2 | 6/1998 | |
| WO | 9937834 | A | 7/1999 | |
| WO | 9954544 | A1 | 10/1999 | |
| WO | 0012810 | A1 | 3/2000 | |
| WO | 0019006 | A1 | 4/2000 | |
| WO | 2001016423 | A1 | 3/2001 | |
| WO | 0116423 | A1 | 8/2001 | |
| WO | 0246522 | A2 | 6/2002 | |
| WO | 2005025865 | A1 | 3/2005 | |
| WO | 2007140578 | A1 | 12/2007 | |
| WO | WO-2008105603 | A1 * | 9/2008 | D01C 1/00 |
| WO | 2013033405 | A1 | 3/2013 | |

OTHER PUBLICATIONS

Smook, Handbook for Pulp and Paper Technologists, 1992, Angus Wilde Publications, 2nd edition, chapter 11.*

Smook, Handbook for Pulp and Paper Technologists, 1992, Angus Wilde Publications, 2nd edition, chapter 5.*

Hamiltyon et al., Secondary Fibers and Non-wood Pulping, 1987, The Joint textbook Committee of the Paper Indsutry, p. 11. (Year: 1987).*

Smook, Handbook for Pulp and Paper Technologists, 1992, Angus Wilde Publications, 2nd edition,chapter 1 (Year: 1992).*

Smook, Handbook for Pulp and Paper Technologists, 1992, Angus Wilde Publications, 2nd edition, chapter 9 (Year: 1992).*

AgrTech, Cotton Linters, 2014, downloaded online May 6, 2020 (Year: 2014).*

(56) References Cited

OTHER PUBLICATIONS

International Search Report and Written Opinion dated Aug. 11, 2015 for PCT/U52015/031553.
International Search Report and Written Opinion dated Jul. 21, 2015 for PCT/US2015/031551.
International Search Report and Written Opinion dated Jul. 21, 2015 for PCT/US2015/031557.
Mortazavi, S. M., et al.; "Evaluating Simultaneous Desizing and Bleaching of Greige Cotton Fabric Using KMnO4"; Textiel Research Journal; vol. 78, No. 6; p. 497-501; 2008.
Hietanan, Tomi M., et al.; "Effects on Pulp Properties of Magnesium Hydroxide in Peroxide Bleaching"; BioResources; vol. 8, No. 2; p. 2337-2350; 2013.
Khristova, P., et al; "Multistage Peroxide Bleaching of French Hemp"; Industrial Crops and Products; vol. 18; p. 101-110; 2003.
Harwood, Ray, et al.; "Cottonisation of Flax"; 2008 International Conference on Flax and Other Bast Plants; p. 118-128; 2008.
Lystad, Elizabeth; "TCF-Bleaching of Softwood Chemical Pulps with Permanganate"; International Pulp Bleaching Conference; p. 357-370; 1996.
Paper Pulp Technical Manual (English translation), Japan Technical Association of the Pulp and Paper Industry, Jan. 30, 1992, 5th edition, 2 pages.
European Supplementary Search Report, Communication dated Nov. 20, 2017, Application No./Patent No. 15796592.2-1308 / 3146109 PCT/US2015031551, pp. 1-9.
"How is pulp made" | UPM Pulp, https://www.upmpulp.com/sustainable-pulp/how-is-pulp-made/, Oct. 3, 2018, 6 pgs.
"Papermaking Translation Series vol. 12" (Compilation Room of Paper Industry Administration of the Ministry of Light Industry, p. 58. Light Industry Press, Feb. 1960) English translation.
"Papermaking Translation Series vol. 12" (Compilation Room of Paper Industry Administration of the Ministry of Light Industry, p. 58. Light Industry Press, Feb. 1960) Chinese Reference.
Mortazavi, S.M., et al.; "Evaluating Simultaneous Desizing and Bleaching of Greige Cotton Fabric Using KMn04"; Textiel Research Journal; vol. 78, No. 6; p. 497-501; 2008.
Floyd, Don E.; "Polyamide Resins", Reinhold Plastics Applications Series, 2nd Ed. Jul. 27, 1966, 119 pages.
Tomi M. Hietanen et al,; Effects on Pulp Properties of Magnesium Hydroxide in Peroxide Bleaching, BioResources 8 (2), 2337-2350.
Soap & Cosmetics New Ideas for Successful Product Development, New Chemical Perspectives, Chemical Week Publication, Mar. 2000; 4 pages.
Common Knowledge (1) Deep Processing of Chemical Organic Material, Hong Zhongling, p. 266, Beijing: Chemical Industry Press Jun. 1997; (English translation).
Common Knowledge (2) The World of Paper, Liu Shao, p. 43, Fujian Schience & Technology Publishing House, Jun. 1994; (English translation).
Common Knowledge (3) Processing Chemistry of Natural Textile Fibers, Deng Yimin, pp. 129-133, Chongqing: Southwest Normal University Press, Aug. 2010; (English translation).
Common Knowledge (4) "Textile Materials", Zhang Yixin, pp. 50-53, Beijing: China Textile Press, Jul. 2009; (English translation).
Batra, S.K.; "Introduction to Nonwovens Technology"; DEStech Publications, Inc. (2012) p. 131-160.
Lee et al., "Antimicrobial and Blood Repellent Finishes for Cotton and Nonwoven Fabrics Based on Chitosan and Fluropolymers", Textile Research Journal, Feb. 1999; pp. 104-112; vol. 69 (2).

* cited by examiner

BLEACHING AND SHIVE REDUCTION PROCESS FOR NON-WOOD FIBERS

CROSS REFERENCE TO RELATED APPLICATION

This application claims benefit of U.S. Provisional Patent Application Ser. No. 61/000,825, filed May 20, 2014, which is incorporated herein in its entirety by reference.

TECHNICAL FIELD

The instant invention generally is related to methods for fiber production. More specifically, the instant invention is related to methods for non-wood fiber bleaching and shive reduction.

BACKGROUND OF THE INVENTION

Plant fibers fall into three groups: seed fibers (e.g., cotton and kapok), stem fibers (bast fibers, e.g., flax and hemp), and leaf fibers (e.g., sisal and kenaf). Bast fibers occur as bundles of fibers, which extend through the length of the plant stems, located between the outer epidermal "skin" layers and the inner woody core (cortex) of the plant. Therefore, bast fiber straw includes three primary concentric layers: a bark-like skin covering layer, a bast fiber layer, and an inner, woody core. The woody core has various names, which depends on the particular plant type. For example, the flax woody core is referred to as "shive." Thus, "shive" refers to all woody-core materials contained in bast fiber plants.

The bundles of fibers are embedded in a matrix of pectins, hemi-celluloses, and some lignin. The lignin must be degraded, for example by "retting" (partial rotting) of the straw, for example by enzymes produced by fungi (e.g., during dew-retting), or bacteria (e.g., during water-retting). Decortication involves mechanically bending and breaking the straw to separate the fiber bundles from the shive and skin layers, and then removing the non-fiber materials using a series of conventional mechanical cleaning stages.

A substantial proportion of the pectin-containing material that surrounds the individual bast fibers is pectin, with the remaining portion being primarily various water-soluble constituents. Pectin is a carbohydrate polymer, which includes partially-methylated poly-galacturonic acid with free carboxylic acid groups present as calcium salts. Pectin is generally insoluble in water or acid, but may be broken down, or hydrolyzed, in an alkaline solution, such as an aqueous solution of sodium hydroxide.

Removal of the pectin-containing material, or gum, is necessary in many instances to utilize the fiber for its intended purposes. Various methods for pectin removal include degumming, or removing, the pectin-containing substances from the individual bast fiber. For example, U.S. Pat. No. 2,407,227 discloses a retting process for the treatment of fibrous vegetable or plant material, such as flax, ramie, and hemp. The retting process employs micro-organisms and moisture to dissolve or rot away much of the cellular tissues and pectins surrounding fiber bundles, facilitating separation of the fiber bundles from the shive and other non-fiber portions of the stem. Thus, the waxy, resinous, or gummy binding substances present in the plant structure are removed or broken down by means of fermentation.

Following retting, the stalks are broken, and then a series of chemical and mechanical steps are performed to produce individual or small bundles of cellulose fiber. However, a common problem still occurring in non-wood fiber processes is the occurrence of shives, which are undesirable particles in finished paper products. Shives includes pieces of stems, "straw," dermal tissue, epidermal tissue, and the like.

Shives are substantially resistant to defiberizing processes, rendering their presence problematic. Even following oxidative bleaching, shives continue to have deleterious effects on the appearance, surface smoothness, ink receptivity, and brightness of a finished paper product. Mechanical removal of shive to the level required for a high value product involves the application of significant mechanical energy, which results in fiber breakage and generation of fines, or small cellulose particles. The fines are a yield loss, increasing the production cost. Further, the broken fibers reduce the overall fiber strength so they either cannot be used in some manufacturing processes and/or result in weak textile or paper products.

Thus, conventional methods of non-wood fiber processing are not sufficiently robust to remove, decolorize, and break up the residual shive present in the fibers. Thus, processed and finished fibers can still include dark particles of shive, which are both aesthetically unattractive and reduce the commercial value of the fiber product. Furthermore, conventional bleaching processes are not sufficiently robust to increase paper brightness to sufficient levels required for commercial products.

Accordingly, there exists an on-going need for a method to both adequately bleach and sufficiently reduce shive presence in non-wood fibers, including plant-based fibers. Thus, the present invention is directed to meeting this and other needs and solving the problems described above.

SUMMARY OF THE INVENTION

The present invention is directed to methods of increasing the brightness of non-wood fibers and nonwoven fabrics, tissues, papers, textiles, and products produced by the methods. In one aspect, the method comprises forming a mixture of non-wood fibers and exposing the mixture to a brightening agent to produce brightened fibers. The brightening agent is oxygen gas, peracetic acid, a peroxide compound, or a combination thereof, to produce brightened fibers. Such brightened fibers have a brightness greater than the fibers of the mixture before exposure to the brightening agent as measured by MacBeth UV-C standard.

In another aspect, a method of reducing the amount of residual shive in non-wood fibers comprises forming a mixture of non-wood fibers and exposing the mixture to a brightening agent to produce low-shive fibers. The brightening agent is oxygen gas, peracetic acid, a peroxide compound, or a combination thereof. Such low-shive fibers have less visible shive content than the fibers of the mixture before exposure to the brightening agent. Yet, in another aspect, a nonwoven fabric made in accordance with this method comprises brightened, non-wood fibers having a brightness greater than about 65 as measured by MacBeth UV-C standard. Nonwoven fabrics include air-laid, carded, spunbond, and hydro entangled substrates.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the present invention. It is important, therefore, that the claims be regarded as including such equivalent constructions insofar as they do not depart from the spirit and scope of the present invention.

Other advantages and capabilities of the invention will become apparent from the following description taken in conjunction with the examples showing aspects of the present invention.

BRIEF DESCRIPTION OF THE DRAWINGS

The invention will be better understood and the above object as well as other objects other than those set forth above will become apparent when consideration is given to the following detailed description thereof. Such description makes reference to the annexed drawing wherein.

DETAILED DESCRIPTION OF THE INVENTION

Figure 1:
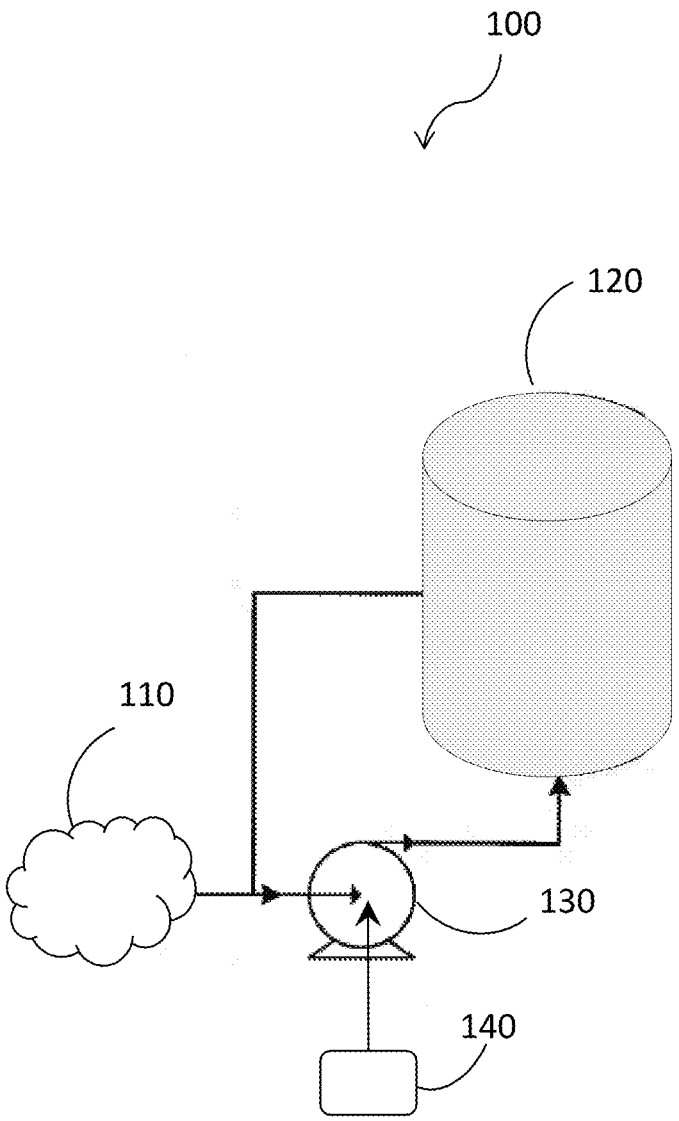
FIG. 1 is an illustration of a method for introducing oxygen gas into a bleaching liquor using within a circulation pump to dissolve the oxygen.

For a fuller understanding of the nature and desired objects of this invention, reference should be made to the above and following detailed description taken in connection with the accompanying figures. When reference is made to the figures, like reference numerals designate corresponding parts throughout the several figures.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

As used herein, the articles "a" and "an" preceding an element or component are intended to be nonrestrictive regarding the number of instances (i.e. occurrences) of the element or component. Therefore, "a" or "an" should be read to include one or at least one, and the singular word form of the element or component also includes the plural unless the number is obviously meant to be singular.

As used herein, the terms "invention" or "present invention" are non-limiting terms and not intended to refer to any single aspect of the particular invention but encompass all possible aspects as described in the specification and the claims.

As used herein, the term "about" modifying the quantity of an ingredient, component, or reactant of the invention employed refers to variation in the numerical quantity that can occur, for example, through typical measuring and liquid handling procedures used for making concentrates or solutions in the real world. Furthermore, variation can occur from inadvertent error in measuring procedures, differences in the manufacture, source, or purity of the ingredients employed to make the compositions or carry out the methods, and the like. Whether or not modified by the term "about," the claims include equivalents to the quantities. In one aspect, the term "about" means within 10% of the reported numerical value. In another aspect, "about" means within 5% of the reported numerical value.

As used herein, the terms "percent by weight," "% by weight," and "wt. %" mean the weight of a pure substance divided by the total dry weight of a compound or composition, multiplied by 100. Typically, "weight" is measured in grams (g). For example, a composition with a total weight of 100 grams, which includes 25 grams of substance A, will include substance A in 25% by weight.

As used herein, the terms "nonwoven" means a web or fabric having a structure of individual fibers which are randomly interlaid, but not in an identifiable manner as is the case of a knitted or woven fabric. The brightened fibers in accordance with the present invention can be employed to prepare nonwoven structures and textiles.

As used herein, the term "non-wood fibers" means fibers produced by and extracted from a plant or animal, the exception that such fibers do not include wood fibers, i.e., derived from a tree, and man-made fibers formed from cellulose, e.g. viscose. Non-limiting examples of suitable non-wood fibers are plant-based, non-wood fibers, such as bast fibers. Bast fibers include, but are not limited to, flax fibers, hemp fibers, jute fibers, ramie fibers, nettle fibers, Spanish broom fibers, kenaf plant fibers, or any combination thereof. Non-wood fibers include seed hair fibers, for example, cotton fibers. Non-wood fibers can also include animal fibers, for example, wool, goat hair, human hair, and the like.

As used herein, the term "kier" means a circular boiler or vat used in processing, bleaching and/or scouring non-wood fibers.

As used herein, the term "brightening agent" refers to oxygen gas, peracetic acid, a peroxide compound, or a combination thereof. In addition to oxygen gas, peracetic acid, and a peroxide compound, other compounds and agents can be included in the brightening agent. Non-limiting examples of additional compounds include reducing agents and magnesium sulfate. The brightening agent can further include other gases, for example nitrogen or carbon dioxide. The oxygen gas can be present as a mixture with other gases. In one example, the oxygen gas is present in the brightening agent about or in any range between about 75, 80, 85, 90, 95, and 100%.

As used herein, the term "brightness" refers to the whiteness of a composition of fibers. As discussed herein, brightness is determined by the "MacBeth UV-C" test method, utilizing a Macbeth 3100 spectrophotometer, commercially available from X-Rite, Inc., Grand Rapids, Mich. UV-C is the illuminant (lamp) used for brightness testing. As used herein, the term "gain" means the increase in fiber brightness following a bleaching process. Brightness and gain measurements of the fibers, before and after exposure to the brightening agent, are conducted on thick pads of the fiber. The fiber pads are prepared by diluting the fibers to a consistency in a range between about 2% and about 10% with water, mixing to separate the fibers, and then dewatering the fibers, for example on a Buchner funnel with a filter paper, to form the fiber pad. The fiber pad can be further dewatered by pressing between blotters in a laboratory press and then dried on a speed dryer to form a dry cake. The fiber pads can then be air-dried for several days prior to brightness testing. Brightness measurements also can be done on the fiber by: 1) drying the fiber with hot air to less than 2-4% moisture, 2) carding the fiber to straighten out and align the fibers into a mat, lap or sliver, and 3) measuring the brightness of the lap, mat or sliver. Brightness and gain testing of the fibers according to the MacBeth UV-C brightness standard is conducted before and after exposure to the brightening agent, with the brightened fibers having a brightness greater than the fibers before exposure. The MacBeth test measures both TAPPI brightness and LAB whiteness. L* is the whiteness, and a* and b* are the color (red-green and blue-yellow). A* and b* values close to 0 indicate very low color/no color. The UV-C test measures the illuminate, including the both the ultraviolet and color components of the light.

As used herein, the term "consistency" means to the percent (%) solid in a composition comprising a solid in a liquid carrier. For example, the consistency of a fiber slurry/fiber mat/fiber mass/fiber donut weighing 100 grams and comprising 50 grams of fibers has a consistency of 50%.

As used herein, the terms "cellulose fibers," "cellulosic fibers," and the like refer to any fibers comprising cellulose. Cellulose fibers include secondary or recycled fibers, regenerated fibers, or any combination thereof.

Conventional plant-based, non-wood fiber production involves mechanical removal of non-fiber shive material, followed by chemical removal of pectin and a mild oxidative bleaching step. Plants, including flax, require an initial "retting" step before mechanical removal of non-fiber material. The retting process employs micro-organisms and moisture to dissolve or rot away much of the cellular tissues and pectins surrounding fiber bundles, thus facilitating separation of the fiber from the stem. Thus, waxy, resinous, or gummy binding substances present in the plant structure are removed or broken down by means of fermentation. Pectin removal can be accomplished using an alkaline agent, such as sodium hydroxide, at elevated temperatures. Enzymes and other chemicals, such as detergents and wetting agents, also can be added to enhance pectin detachment from the fibers. U.S. Pat. Nos. 8,603,802 and 8,591,701 and Canadian Patent No. CA 2,745,606 disclose methods for pectin removal using enzymes. Following the pectin extraction step, the fibers are washed and treated with a mixture of hydrogen peroxide and sodium hydroxide to increase the brightness and whiteness of the finished fiber.

However, there are drawbacks to these conventional methods. First, available pectin extraction and bleaching steps are not robust enough to decolorize and/or break up residual shive in the fiber. Second, the bleaching process also is not robust enough to increase the brightness to levels required for high quality commercial products. The result is finished fibers containing dark shive particles, which is aesthetically unappealing and reduces the commercial value of the fiber product. The shive also interferes with the manufacturing processes which utilize the fiber. For example, particles of shive can plug the filters on a hydro entanglement system. The shive also has very low bonding ability. Thus, any shive entrained in the finished product will fall out and be unappealing to the end user. Further, residual shive could also be a potential source of contamination when used, for example, in food service wipes.

One commercially available solution to the shive problem is to either increase the intensity of the mechanical shive removal process or to add multiple mechanical removal stages so that the residual shive content is low enough to be imperceptible in the finished product. However, this solution has drawbacks. First, additional mechanical processing increases the operating and capital costs of production. Second, the additional mechanical processing damages the fragile fibers, resulting in a product with inferior tensile strength properties. Finally, additional mechanical processing reduces the yield of the finished fiber because of the generation of fines and long fiber losses due to the inherent inefficiency of mechanical processing.

It was discovered that the addition of oxygen gas and/or peracetic acid to the bleaching process both increases the fiber brightness and reduces the residual shive to levels that dramatically reduce the impact of shive on the appearance of the finished fiber. Furthermore, and without being bound by theory, it is believed that the brightening process disclosed herein reduces the integrity of the shives so that they are more easily broken up and removed in mechanical treatment. Reduced shive content after exposure to the brightening agent can be assessed by visual examination of the fibers.

Accordingly, the present disclosure is directed to a method of increasing the brightness of natural fibers, in particular, non-wood fibers. In one aspect of the present invention, the method comprises forming a mixture of non-wood fibers and exposing the mixture to a brightening agent to produce brightened fibers having a brightness greater than the fibers of the mixture before exposure as measured by MacBeth UV-C standard. The brightening agent comprises oxygen gas, peracetic acid, a peroxide compound, or a combination thereof. In another aspect, the present disclosure is directed to a method of reducing the amount of residual shive in non-wood fibers to provide low-shive fibers having less visible shive content than the fibers of the mixture before exposure.

One category of non-wood fibers is bast fibers. Bast fibers are found in the stalks of the flax, hemp, jute, ramie, nettle, Spanish broom, and kenaf plants, to name only a few. Typically, native state bast fibers are 1 to 4 meters in length. These long native state fibers are comprised of bundles of straight individual fibers that have lengths between 20-100 millimeters (mm). The bundled individual fibers are glued together by pectins.

Bast fibers bundles can be used for both woven textiles and cordage. An example of a woven textile produced with flax bast fiber bundles is linen. More recently, as provided in U.S. Pat. No. 7,481,843, which is incorporated herein in its entirety by reference, partially separated bast fiber is produced to form yarns and threads for woven textiles. However, yarns and threads are not suited for nonwoven fabrics.

In accordance with the present invention, any non-wood fibers can be used. In one example, suitable fibers include cotton fibers, bast fibers, or any combination thereof. Bast fibers can be derived from a variety of raw materials. Non-limiting examples of suitable bast fibers include, but are not limited to, flax fibers, hemp fibers, jute fibers, ramie fibers, nettle fibers, Spanish broom fibers, kenaf plant fibers, or any combination thereof. Non-wood fibers can also include animal fibers, for example, wool, goat hair, human hair, and the like.

Initially, pectin can be substantially removed from the non-wood, plant-based fibers to form substantially individualized fibers. Thus, the fibers are rendered substantially straight and are substantially pectin-free. The fibers can be individualized, by pectin removal, using mechanical or chemical means.

Enzymatic treatment is a non-limiting example of a chemical treatment that can be used to substantially remove pectin. PCT International Publication No. WO 2007/140578, which is incorporated herein in its entirety by reference, describes a pectin removal technology which produces individualized hemp and flax fiber for application in the woven textile industry. The process to remove pectin described in WO 2007/140578 can be employed.

The non-wood, plant-based fibers can have a mean length in a range between about 1 and 100 mm depending on the characteristics of the particular fibers and the cut length of the plant stalks prior to chemical processing. In one aspect, the individualized non-wood, plant-based fibers have a mean length of at least 10 mm, at least 20 mm, at least 30 mm, and at least 40 mm. In another aspect, the individualized non-wood, plant-based fibers have a mean length greater than 50 mm. Still yet, in another aspect, the non-wood, plant based fibers have a mean length about or in a range between about 5, 10, 15, 20, 25, 30, 35, 40, 45, 50, 55, 60, 65, 70, 75, 80, 85, 90, and 95 mm.

In addition to non-wood, plant-based fibers, the fiber mixture can include fibers derived from one or more source, including, but not limited to, cellulosic fibers, including staple fibers, regenerated cellulose fibers, and thermoplastic fibers. Optionally, the cellulosic fibers are secondary, recycled fibers. Non-limiting examples of cellulosic fibers include, but are not limited to, hardwood fibers, such as hardwood kraft fibers or hardwood sulfite fibers; softwood fibers, such as softwood kraft fibers or softwood sulfite fibers; or any combination thereof. Non-limiting examples of regenerated cellulose include rayon, lyocell, (e.g., TENCEL®), Viscose®, or any combination thereof. TENCEL® and Viscose® are commercially available from Lenzing Aktiengesellschaft, Lenzing, Austria.

In one aspect, the mixture of non-wood fibers includes synthetic, polymeric, thermoplastic fibers, or any combination thereof. Thermoplastic fibers include the conventional polymeric fibers utilized in the nonwoven industry. Such fibers are formed from polymers which include, but are not limited to, a polyester such as polyethylene terephthalate; a nylon; a polyamide; a polypropylene; a polyolefin such as polypropylene or polyethylene; a blend of two or more of a polyester, a nylon, a polyamide, or a polyolefin; a bi-component composite of any two of a polyester, a nylon, a polyamide, or a polyolefin; and the like. An example of a bi-component composite fiber includes, but is not limited to, a fiber having a core of one polymer and a sheath comprising a polymer different from the core polymer which completely, substantially, or partially encloses the core.

Brightness measurements of the fibers, before and after exposure to the brightening agent, can be conducted on thick pads of the fiber. Brightness testing of the fibers according to the MacBeth UV-C brightness standard is conducted before and after exposure to the brightening agent, with the brightened fibers having a brightness greater than the fibers before exposure. The brightened fibers of the present invention can have a brightness in a range between about 65 and about 90 as measured by MacBeth UV-C standard. In one aspect, the brightened fibers have a brightness in a range between about 77 and about 90. In another aspect, the brightened fibers have a brightness in a range between about 80 and about 95. Yet, in another aspect, the brightened fibers have a brightness in a range between about 65 and about 85.

The brightness gain, or increase in fiber brightness following exposure to the brightening agent is in a range between about 10 and about 60 as measured by MacBeth UV-C standard. In one aspect, the brightness gain is in a range between about 15 and about 30 as measured by MacBeth UV-C standard. In another aspect, the brightness gain is in a range between about 45 and about 55 as measured by MacBeth UV-C standard. Yet, in another aspect, the brightness gain is about or in any range between about 10, 15, 20, 25, 30, 35, 40, 45, 50, 55, and 60 as measured by MacBeth UV-C standard.

The brightened fibers of the present invention can be used for any nonwoven fabric products or textiles, including air-laid, carded, spunbonded, and hydroentangled substrates. In one aspect, a nonwoven fabric comprises non-wood fibers having a brightness greater than about 65 as measured by MacBeth UV-C standard.

Nonwood fiber brightening can be accomplished by 1) retting, mechanical separation of bast fibers, scouring to remove pectin+waxes+lignin, and one or two stage brightening as disclosed herein; or 2) retting, mechanical separation of bast fibers, scouring to remove pectin+waxes+lignin, conventional peroxide or other bleaching/pre-bleaching, and one or two stage bleaching with the disclosed process.

Then, the non-wood fibers (pre-bleached or unbleached) are combined to form a mixture. Pectin removal by chemical methods can be performed before or after forming the mixture. The mixture can be formed into a fibrous mat, a fiber mat, a fiber pad, a thick fiber pad, a wet cake, or a "donut" when used in a kier based system. Optionally, the mixture can then be wetted before exposing the mixture to the brightening agent. The mixture can be diluted to any desired consistency, wetted, and/or combined with any desired additives, non-limiting examples of which are mentioned below.

In the mixture before exposure to the brightening agent, the fibers have a consistency in a range between about 1% and about 50%. In one aspect, the fibers in the mixture have a consistency in a range between about 10% and about 30%. In another aspect, the fibers in the mixture have a consistency in a range between about 15% and about 35%. Yet in another aspect, the fibers in the mixture have a consistency in a range between about 20% and about 40%. Still yet, in another aspect, the fibers in the mixture have a consistency about or in any range between about 1, 2, 5, 7, 10, 12, 15, 17, 20, 22, 25, 27, 30, 32, 35, 37, 40, 42, 45, 47 and 50%.

To increase the brightness of the fibers, the mixture is then exposed to a brightening agent, the brightening agent being oxygen gas, peracetic acid, a peroxide compound, or a combination thereof. Non-limiting exemplary methods for exposing the mixture to the brightening agent are shown in FIGS. 1-8 (discussed in detail below). However, the fiber mixture can be exposed to the brightening agent by any suitable method. Pectin can be removed from the fibers before exposure to the oxygen gas, peracetic acid, and/or a peroxide compound.

Peracetic acid ($CH_3CO_3H$) can be produced by autoxidizing acetaldehyde in the air. Alternatively, peracetic acid can be produced by reacting acetic acid with hydrogen peroxide or acetyl chloride with acetic anhydride. In addition, tetra acetyl ethylene diamine (TAED) can be added to an alkaline hydrogen peroxide solution to form peracetic acid. The resulting peracetic acid provides an increased brightening effect compared to the alkaline hydrogen peroxide alone.

TAED can be added to the brightening agent or the fibers to increase the effective brightening on the fibers. In one aspect, the brightening agent further comprises a peroxide compound and an alkaline compound. In another aspect, the peroxide compound is hydrogen peroxide and the alkaline compound is sodium hydroxide or potassium hydroxide. Addition of the TAED produces peracetic acid. Optionally, the fibers can be exposed to the peracetic acid before, after, or during exposure to oxygen gas, as described in detail below. As both peracetic acid and oxygen gas increase the brightness of the fibers, they can be used alone or in combination. The peracetic acid can be generated in situ with the fiber or can be generated by pre-mixing the various chemicals and then added to the fiber mixture. A peroxide compound, for example hydrogen peroxide or another alkaline compound, can be present when either oxygen gas or TAED is present in the brightening agent.

When TAED is used, it can be added in an amount in a range between about 0.1 and about 1 wt. % based on the dry weight of the fibers. In one aspect, the TAED is added in an amount in a range between about 0.5 and about 5 wt. % based on the dry weight of the fibers. In another aspect, the TAED is added in an amount in a range between about 0.3 and about 3 wt. % based on the dry weight of the fibers. Yet, in another aspect, the TAED is added in an amount about or in any range between about 0.1, 0.2, 0.3, 0.5, 0.7, 1.0, 1.2, 1.5, 2.0, 2.5, 3.0, 3.5, 4.0, 4.5, 5.0, 5.5, 6.0, 7.0, 8.0, 9.0, and 10.0 based on the dry weight of the fibers.

The peroxide compound of the brightening agent can be hydrogen peroxide, sodium peroxide, or both hydrogen peroxide and sodium peroxide. The brightening agent can include other additional bleaching components, for example other peroxide compounds and an alkaline compound. Non-limiting examples of suitable peroxide compounds include hydrogen peroxide, sodium peroxide, or both hydrogen peroxide and sodium peroxide. Suitable alkaline compounds include, but are not limited to, sodium hydroxide, potassium hydroxide, calcium hydroxide, monoethanolamine, ammonia, or any combination thereof. After exposing the fibers to the brightening agent, the fibers can be mixed or agitated. However, excessive mixing can induce fiber tangling.

The brightening agent pH can be adjusted to an initial pH in a range between about 9 and about 12. In one aspect, the initial pH is in a range between about 10 and about 10.5. In another aspect, the initial pH is in a range between about 9.5 and about 10.5. Yet in another aspect, the initial pH is in a range about or in any range between about 8, 8.5, 9, 9.5, 10, 10.5, and 11. Additional pH buffering agents can be included to adjust the mixture to the desired pH. Sodium hydroxide and/or magnesium hydroxide can be used.

Turning now to the figures, FIG. 1 illustrates an exemplary method 100 of exposing the fiber mixture to the brightening agent, which includes oxygen gas alone, or in combination with peracetic acid. Peracetic acid can be added or generated in situ in the bleaching liquor 140 as described above. The non-wood fibers can be disposed within a fiber processing Kier 120. The bleaching liquor 140, which can include additional components such as the peroxide compound, peracetic acid, TAED, or the alkaline compound, can be introduced and circulated through the system and the fibers with a liquor circulation pump 130. The oxygen gas 110 is injected into the bleaching liquor circulation pump 130, which acts to mix and dissolve the oxygen gas 110 into the bleaching liquor 140. The oxygen gas 110 can be injected until the desired system pressure or partial oxygen pressure is achieved, or until the oxygen is dissolved in the solution, forming a dissolved oxygen solution. Alternatively, a low, continuous flow of oxygen gas 110 can be maintained throughout the process.

Figure 2:
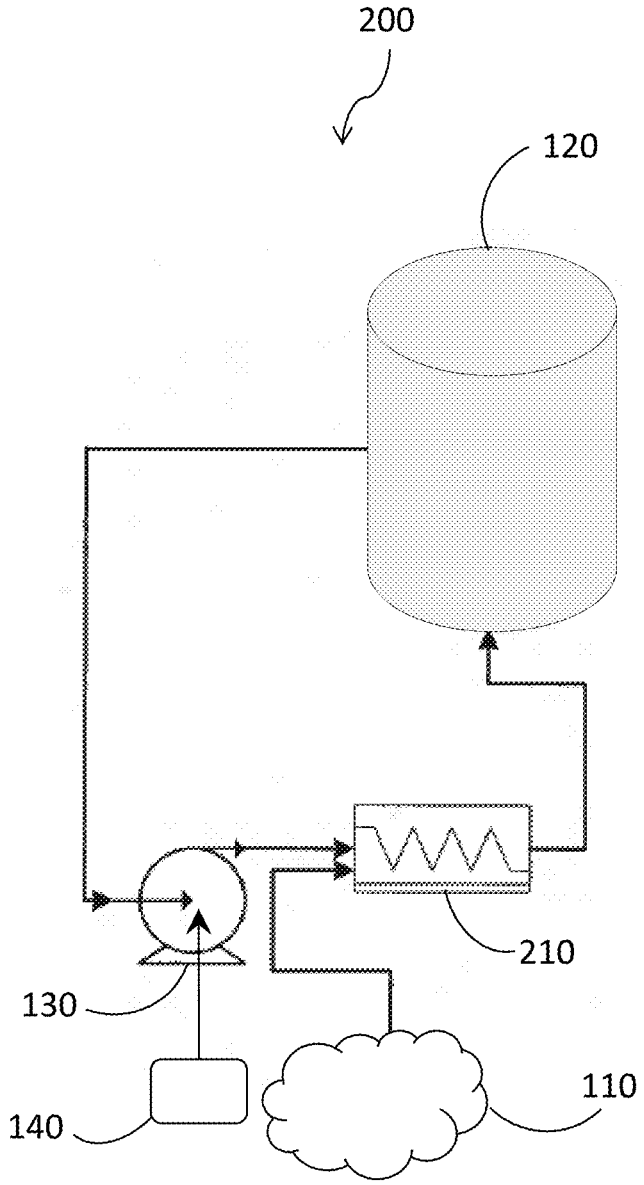
FIG. 2 is an illustration of a method for introducing oxygen gas into a mixer after the circulation pump.

FIG. 2 illustrates an exemplary method 200 of exposing the fiber mixture to the brightening agent. As shown, the oxygen gas 110 can be introduced into a static or active mixing system 210 after the liquor circulation pump 130.

Figure 3:
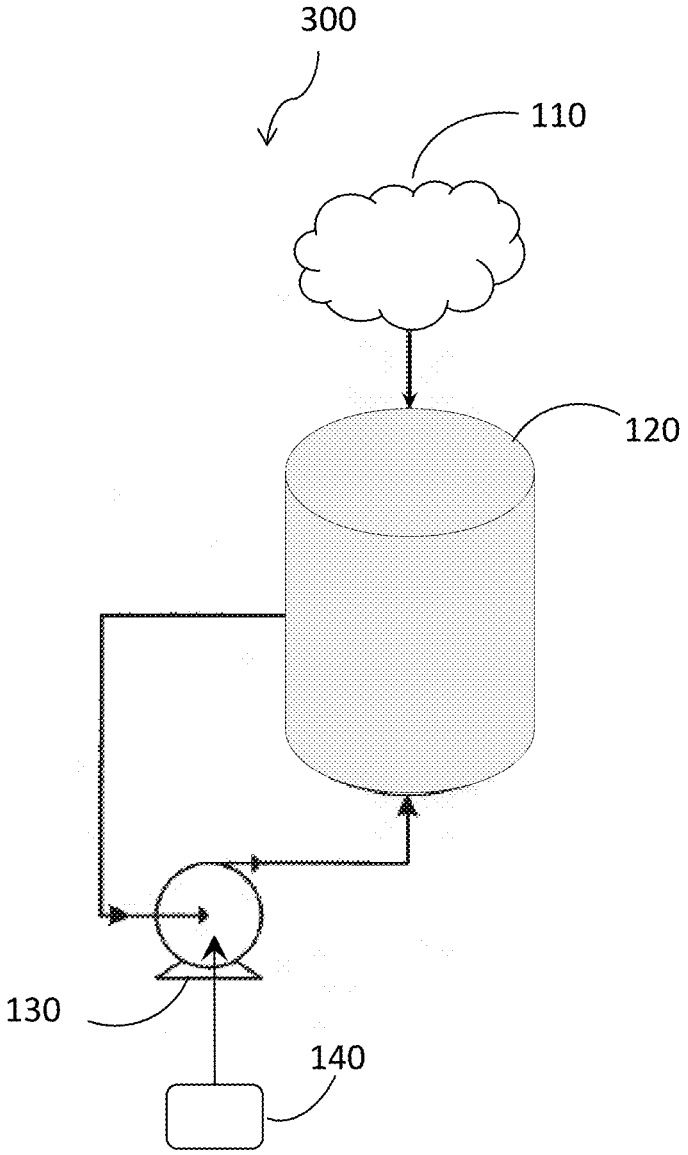
FIG. 3 is an illustration of a method for introducing oxygen gas directly into the non-wood fibers.

FIG. 3 illustrates an exemplary method 300 of exposing the fiber mixture to the brightening agent. As shown, oxygen gas 110 is directly introduced into top of the fiber processing Kier 120. As such, the oxygen gas 110 permeates the fibers, which can be in the form of a "fiber mat," to react with the chromophores and shive, reducing the content of shive.

Figure 4:
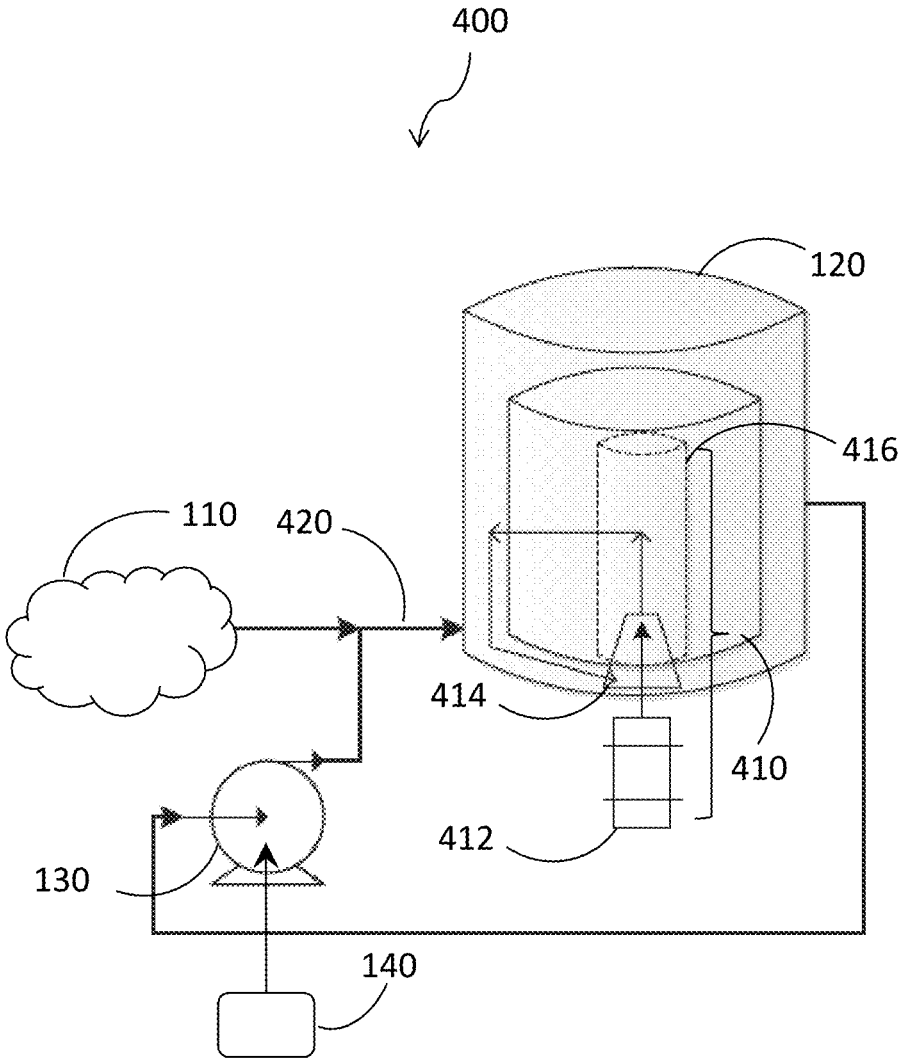
FIG. 4 is an illustration of a method for exposing the non-wood fibers to oxygen gas using an internal and external liquor circulation system.

FIG. 4 illustrates an exemplary method 400 of exposing the fiber mixture to the brightening agent. Method 400 has an additional internal circulation system 410 in addition to the external liquor circulation systems of methods 100, 200, and 300 using the liquor circulation pump 130. Oxygen gas 110 is injected into the liquor feed line 420 after the liquor circulation pump 130 which goes directly into the intake of the internal pump 412. The entrained oxygen gas 110 enters the impeller 414, which mixes and dissolves the oxygen gas 110 in the bleaching liquor 140. The bleaching liquor 140, along with the dissolved oxygen gas 110 then enters the center shaft 416 of the basket and then travels and circulates through the fiber mass within the fiber processing Kier 120.

Figure 5:
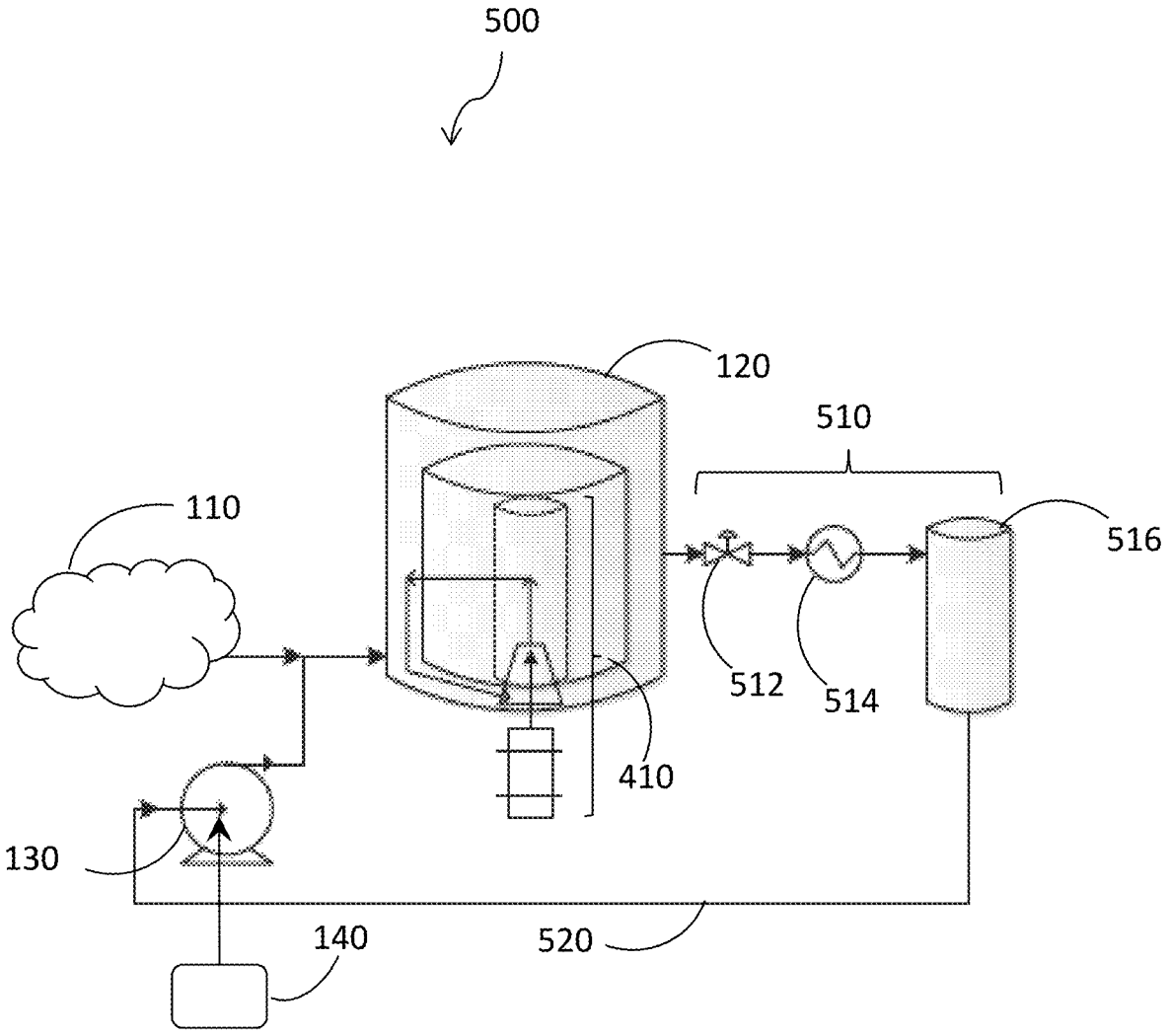
FIG. 5 is an illustration of a method for cooling the liquor in the system of FIG. 4.

FIG. 5 is an illustration of a method 500 for cooling the liquor in the method 400 shown in FIG. 4. In method 500, employing a cooling system 510, the bleaching liquor 140 from inside the fiber processing Kier 120 is cooled below the flash temperature, for example, less than about 100° C., in a noncontact heat exchanger 514 and then into a small liquor tank 516. A control valve 512 controls the recirculation of the system and also holds the pressure in the system. The cooled liquor 520 is then is pumped back into the liquor circulation pump 130 of the external circulation system. The cooling system 510 allows for addition of chemicals without depressurizing and emptying the fiber processing kier 120.

Figure 6:
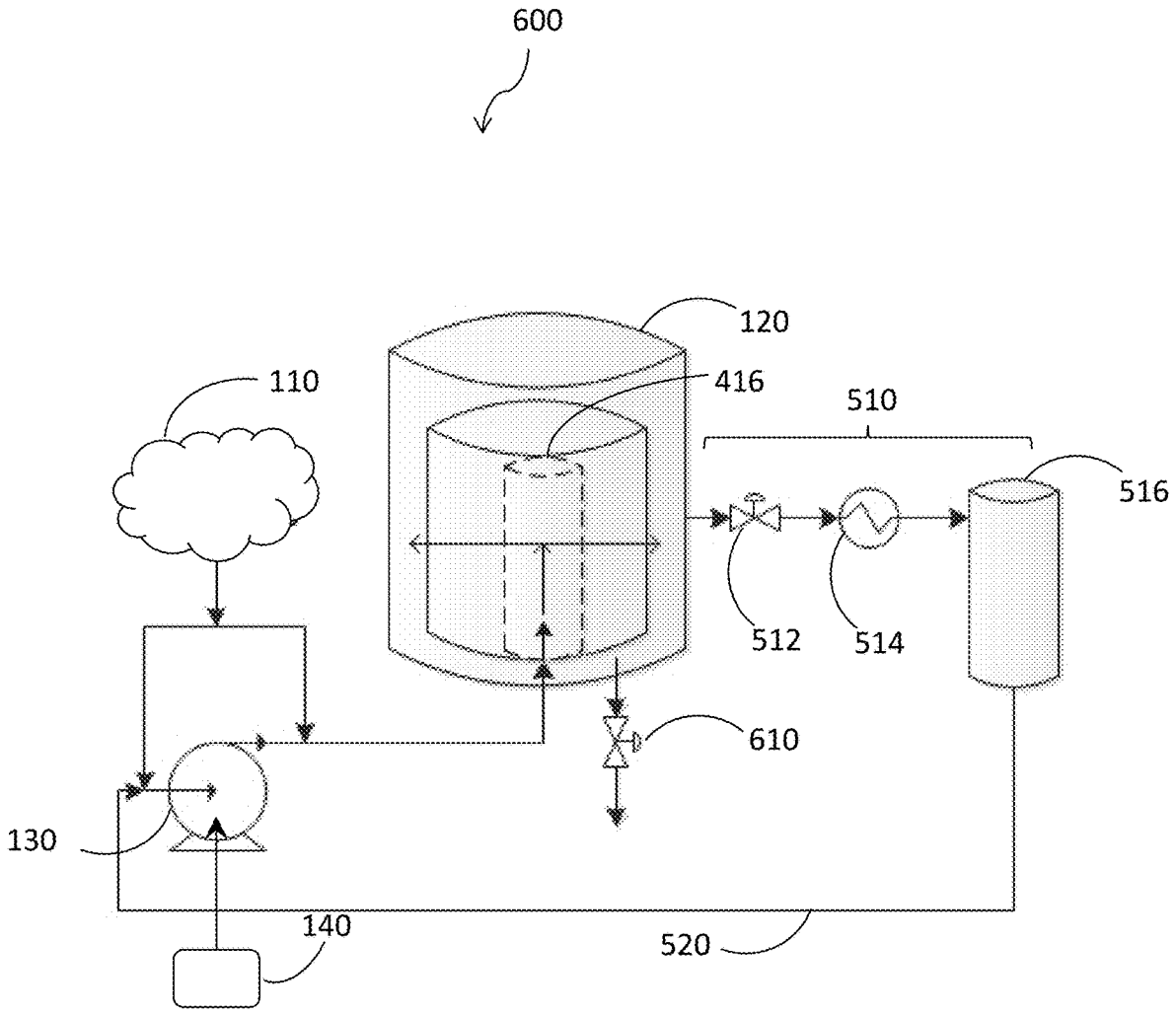
FIG. 6 is an illustration of a method for using gas to displace the residual liquor from the fibers in the system of FIG. 4.

FIG. 6 is an illustration of a method 600 for using oxygen gas to displace the residual liquor from the fibers in the method 400 shown in FIG. 4. In method 600, the bleaching liquor 140 is drained from the fiber processing Kier 120 by using a drain valve 610. Then, oxygen gas 110 is injected directly into the center shaft 416 of the basket and diffuses through the fibers in the fiber processing Kier 130.

Figure 7:
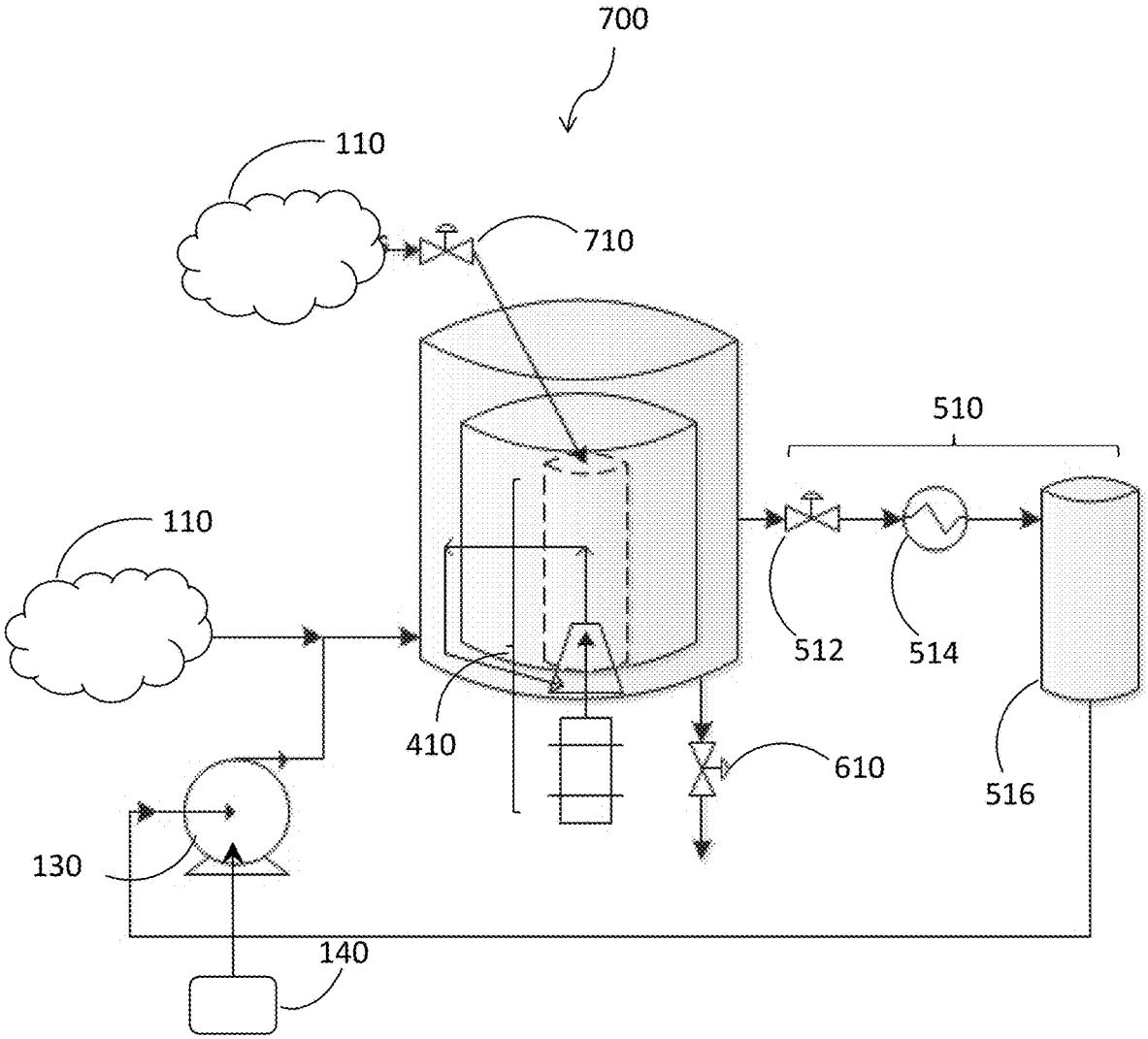
FIG. 7 is an illustration of another method for using gas to displace the residual liquor from the fibers in the system of FIG. 4.

FIG. 7 is an illustration of another method 700 for using oxygen gas 110 to displace the residual liquor from the fibers in the method 400 shown in FIG. 4. In method 700, the bleaching liquor 140 is also drained from the fiber processing Kier 120 using a drain valve 610. The fiber processing Kier 120 has an oxygen gas connection with a check valve 710 at the top of the fiber processing Kier 120, at the bottom of the fiber processing Kier (not shown), or on the liquor circulation pump 130 (not shown). Thus, oxygen gas can be injected, and vented, into the system using check valve 710.

Figure 8:
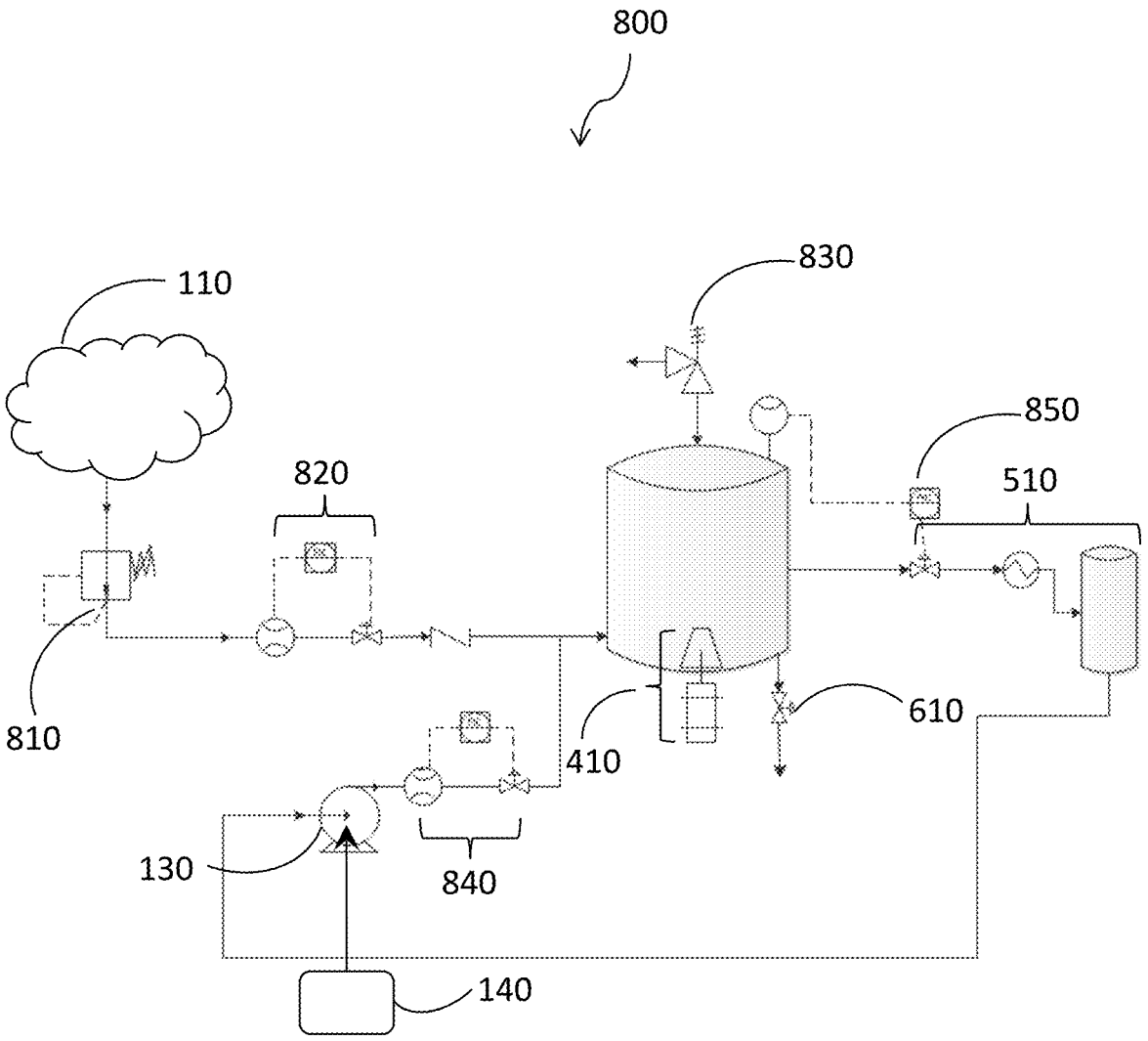
FIG. 8 is an illustration of a control system for oxygen brightening of non-wood fibers.
Figure 9:
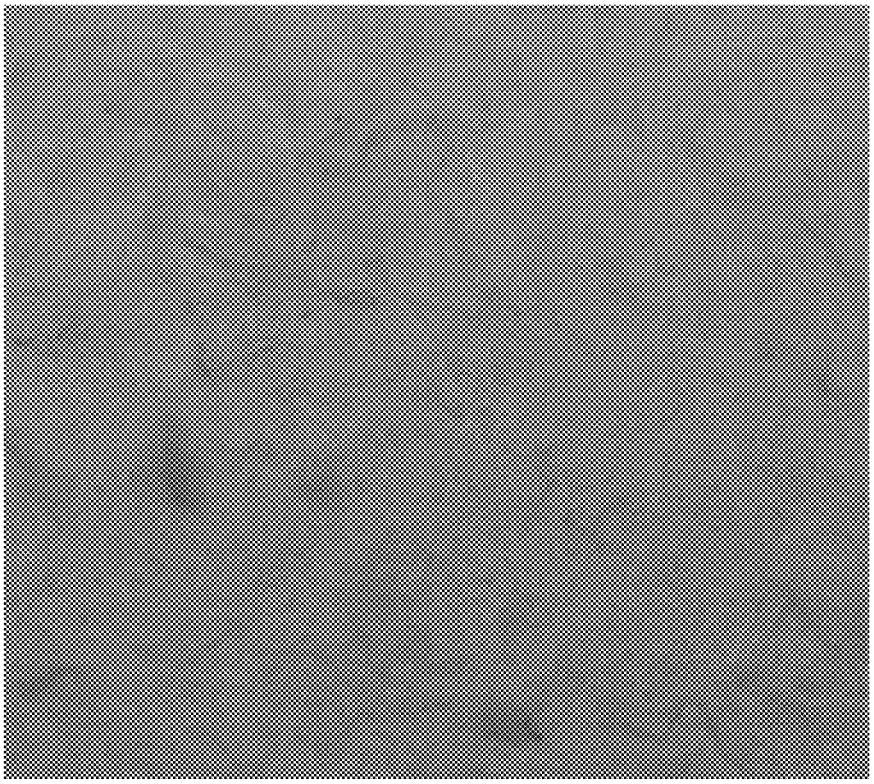
FIG. 9 is a photomicrograph of control flax fibers which were chemically treated to remove pectin and hydrogen peroxide bleached.

FIG. 8 is an illustration of a control system 800 for brightening of non-wood fibers in any kier system. The control system 800 has an oxygen tank or other oxygen source for injecting oxygen gas 110. A pressure control device 810 controls the pressure of oxygen gas 110 from the primary source. An oxygen flow control device 820 then controls the flow of oxygen into the system. A liquor flow control device 840 after the liquor circulation pump 130 controls the flow of bleaching liquor 140 into the system. A pressure relief safety valve 830 limits the maximum safe pressure within the fiber processing Kier 120. A Kier pressure control 850 also moderates the pressure within the fiber processing Kier 120.

In another aspect, the fiber mixture can be disposed within any closed system, including a fiber processing Kier. The fiber mixture is saturated with an alkaline peroxide bleaching liquor, e.g., hydrogen peroxide and sodium hydroxide, and then the system is drained and pressurized with oxygen. As a result, the oxygen permeates the fiber mixture, or "fiber mat," to enhance the action of the peroxide liquor. Thus, the brightness of the fibers is increased compared to the fibers before exposure.

During oxygen gas exposure, the system can be maintained at a temperature in a range between about 50 and about 150° C. In another aspect, the system can be maintained at a temperature in a range between about 70 and about 140° C. during oxygen exposure. Yet, in another aspect, the system can be maintained at a temperature in a range between about 70 and about 130° C. during oxygen exposure. Still yet, in another aspect, the system can be maintained at a temperature about or in any range between about 50, 55, 60, 65, 70, 75, 80, 85, 90, 95, 100, 105, 110, 115, 120, 125, 130, 135, 140, 145, and 150° C.

The fibers can be exposed to the peracetic acid during or after exposure to the oxygen gas by addition of peracetic acid or by adding TAED to hydrogen peroxide to form peracetic acid. In one aspect, the TAED is added at the end of the oxygen exposure stage, for example after exposing the fibers to oxygen for about 30 minutes to about 60 minutes. In another aspect, the fibers are exposed to TAED or peracetic acid after exposing the fibers to oxygen for about 20 minutes to about 45 minutes. Yet, in another aspect, the fibers are exposed to TAED or peracetic acid after exposing the fibers to oxygen for about 40 minutes to about 60 minutes.

Optionally, TAED or peracetic acid can be added to the fibers at temperatures lower than the oxygen exposure. For example, the temperature of TAED or peracetic acid addition can be in a range between about 60 and about 100° C. In another aspect, the temperature of TAED or peracetic acid addition to the fibers can be in a range between about 70 and about 90° C. Yet, in another aspect, the temperature of TAED or peracetic acid addition to the fibers can be in a range between about 70 and about 80° C. Still yet, the temperature of TAED or peracetic acid addition can be about or in any range between about 60, 65, 70, 75, 80, 85, 90, 95, and 100° C.

Magnesium compounds can be added to the mixture of non-wood fibers during exposure to the oxygen gas, peracetic acid, or combination of oxygen gas and peracetic acid. In one aspect of the present invention, magnesium sulfate functions as both a stabilizer for oxidizing agents during bleaching/brightening process and as a protecting agent for the cellulose within the fibers by reducing oxidation. In another aspect, other magnesium compounds, for example magnesium sulfate and magnesium hydroxide may provide both alkalinity and a buffering capacity, which may be beneficial. Yet in another aspect, other suitable magnesium compounds can be included in the brightening agent and may include any magnesium salts or compounds including magnesium. Non-limiting examples of suitable magnesium compounds include magnesium hydroxide, magnesium oxide, magnesium sulfate, magnesium glycinate, magnesium ascorbate, magnesium chloride, magnesium orotate, magnesium citrate, magnesium fumarate, magnesium malate, magnesium succinate, magnesium tartrate, magnesium carbonate, or any combination thereof.

During the brightening process, the partial oxygen pressure is in a range between about 0.5 and about 10 Bar. Maintaining the system under pressure may promote oxygen dissolution in solution. Further, the amount of oxygen available to the fibers during brightening may promote brightening. For example, providing between about 0.1% and about 2% on fiber oxygen in the system is a factor in promoting increased brightening. For example, as shown in FIG. 8, flow control 820 can be a mass flow sensor that can be set to control the total mass of oxygen added to the kier. Oxygen gas can be added either very quickly at the beginning of the process, added slowly throughout the process, added very quickly at the end of the process, or any combination thereof. In one aspect, the fibers are exposed to at least about 0.1% on fiber oxygen during brightening. In another aspect, the fibers are exposed to at least about 1% on fiber oxygen during brightening. Yet, in another aspect, the fibers are exposed to between about 0.1 and about 10.0% on fiber oxygen during brightening. Still yet, in another aspect, the fibers are exposed to at least about or between about 0.1, 0.2, 0.3, 0.4, 0.5, 0.6, 0.7, 0.8, 0.9, 1.0, 1.1, 1.2, 1.4, 1.6, 1.8, 2.0, 3.0, 4.0, 5.0, 6.0, 7.0, 8.0, 9.0, and 10.0% on fiber oxygen during brightening.

The system may be maintained under pressure, for a time sufficient to improve the brightness and reduce the shive content of the fibers without damaging the fibers. In one aspect, the system is maintained under pressure for a time in a range between about 5 and about 60 minutes. In another aspect, the system is maintained under pressure for a time in a range between about 10 and about 30 minutes. Yet, in another aspect, the system is maintained under pressure for a time in a range between about 20 and about 50 minutes. Still yet, in another aspect, the system is maintained under pressure for a time about or in any range between about 5, 10, 15, 20, 25, 30, 35, 40, 45, 50, 55, 60, 65, 70, 65, 80, 85, 90, 95, 100, 105, 110, 115, and 120 minutes.

Once the brightness of the fibers has been sufficiently increased, and the shive content sufficiently reduced, the oxygen pressure can then be relieved or the oxygen addition can be stopped. Subsequently, the used bleaching components are removed from the system, and water can be used to rinse the system and remove residual bleaching components and dissolved compounds from the fibers.

Subsequent to the oxygen gas, peracetic acid, and/or peroxide compound exposure (first stage of brightening), the brightened fibers, which have a brightness greater than the fibers of the mixture before exposure, can be subjected to at least a second stage of bleaching (without oxygen, second brightening agent/second stage of brightening) to further increase the brightness. The additional stages of brightness can include any additional brightening agents. The additional brightening agent(s) can be a peroxide compound, an alkaline compound, a reducing agent, magnesium sulfate or a combination thereof.

Unexpectedly, exposure to oxygen gas during brightening dramatically improved the performance of a subsequent reductive bleaching stage. In contrast, reductive bleaching typically is generally not effective on plant-based non-wood fibers in conventional processes. Thus, only after an oxygen treatment in a first stage of brightening is it possible to use reductive bleaching in a second brightening stage effectively. This result is a major commercial advantage because reductive bleaching is much less expensive than oxidative bleaching.

In one aspect, a second stage of brightening/bleaching is performed using a peroxide compound and an alkaline compound. Subsequently, a reducing agent is used in a reductive bleaching stage to further increase brightness. In another aspect, a reducing agent is used in a second stage of brightening after initial brightening with oxygen gas, peracetic acid, and/or a peroxide compound. Non-limiting examples of suitable reducing agents include sodium hydrosulfite, potassium hydrosulfite, sodium sulfite, potassium sulfite, sodium sulfate, potassium sulfate, sodium bisulfite, potassium bisulfite, sodium metasulfite, potassium metasulfite, sodium borohydride, or any combination thereof.

The brightened fibers can be used to make nonwoven fabrics and/or textiles according to conventional processes known to those skilled in the art. The nonwoven fabrics, textiles, and other products can include any amount of the brightened fibers disclosed herein. For example, nonwoven fabrics can include about or in any range between about 5, 10, 15, 20, 25, 30, 25, 40, 45, 50, 55, 60, 65, 70, 75, 80, 85, 90, 95, and 100 wt. % of the brightened fibers.

The nonwoven fabric described herein can be incorporated into a variety of textiles and products. Non-limiting examples of products include wipers (or wipes), such as wet wipers, dry wipers, or impregnated wipers, which include personal care wipers, household cleaning wipers, and dusting wipers. Personal care wipers can be impregnated with, e.g., emollients, humectants, fragrances, and the like. Household cleaning wipers or hard surface cleaning wipers can be impregnated with, e.g., surfactants (for example, quaternary amines), peroxides, chlorine, solvents, chelating agents, antimicrobials, fragrances, and the like. Dusting wipers can be impregnated with, e.g., oils.

Non-limiting examples of wipers include baby wipes, cosmetic wipes, perinea wipes, disposable washcloths, household cleaning wipes, such as kitchen wipes, bath wipes, or hard surface wipes, disinfecting and germ removal wipes, specialty cleaning wipes, such as glass wipes, mirror wipes, leather wipes, electronics wipes, lens wipes, and polishing wipes, medical cleaning wipes, disinfecting wipes, and the like. Additional examples of products include sorbents, medical supplies, such as surgical drapes, gowns, and wound care products, personal protective products for industrial applications, such as protective coveralls, sleeve protectors, and the like, protective coverings for automotive applications, and protective coverings for marine applications. The nonwoven fabric can be incorporated into absorbent cores, liners, outer-covers, or other components of personal care articles, such as diapers (baby or adult), training pants, feminine care articles (pads and tampons) and nursing pads. Further, the nonwoven fabric can be incorporated into fluid filtration products, such air filters, water filters, and oil filters, home furnishings, such as furniture backing, thermal and acoustic insulation products, agricultural application products, landscaping application products, and geotextile application products.

A nonwoven web of staple fibers can be formed by a mechanical process known as carding as described in U.S. Pat. No. 797,749, which is incorporated herein in its entirety by reference. The carding process can include an airstream component to randomize the orientation of the staple fibers when they are collected on the forming wire. A state of the art mechanical card, such as the Trützschler-Fliessner EWK-413 card, can run staple fibers having significantly shorter length than the 38 mm noted above. Older card designs may require longer fiber length to achieve good formation and stable operation.

Another common dry web forming process is air-laid or air-forming. This process employs only air flow, gravity, and centripetal force to deposit a stream of fibers onto a moving forming wire that conveys the fiber web to a web bonding process. Air-laid processes are described in U.S. Pat. Nos. 4,014,635 and 4,640,810, both of which are incorporated herein in their entirety by reference. Pulp-based air-formed nonwoven webs frequently incorporate thermoplastic fibers that melt and bond the air-laid web together when the air-formed web is passed through ovens.

Thermal bonding is also referred to as calendar bonding, point bonding, or pattern bonding, can be used to bond a fiber web to form a nonwoven fabric. Thermal bonding can also incorporate a pattern into the fabric. Thermal bonding is described in PCT International Publication No. WO/2005/025865, which is incorporated herein by reference in its entirety. Thermal bonding requires incorporation of thermoplastic fibers into the fiber web. Examples of thermoplastic fibers are discussed above. In thermal bonding, the fiber web is bonded under pressure by passing through heated calendar rolls, which can be embossed with a pattern that transfers to the surface of the fiber web. During thermal bonding, the calendar rolls are heated to a temperature at least between the glass transition temperature ($T_g$) and the melting temperature ($T_m$) of the thermoplastic material.

Brightened fibers are formed into an unbounded web in the wet or dry state. In one aspect, the web is formed by a method employing a mechanical card. In another aspect, the web is formed by a method employing a combination of a mechanical card and a forced air stream. The dry web can be bonded by hydro entangling, or hydroentanglement. In addition, the hydroentangled web can be treated with an aqueous adhesive and exposed to heat to bond and dry the web. Also, the dry web can be bonded by mechanical needle punching and/or passing a heated air stream through the web. Alternatively, the dry web can be bonded by applying an aqueous adhesive to the unbounded web and exposing the web to heat.

Hydroentanglement, also known as spunlacing, or spunbonding, to form non-woven fabrics and substrates is well-known in the art. Non-limiting examples of the hydroentangling process are described in Canadian Patent No. 841,938 and U.S. Pat. Nos. 3,485,706 and 5,958,186. U.S. Pat. Nos. 3,485,706 and 5,958,186, respectively, are incorporated herein in their entirety. Hydroentangling involves forming a fiber web, either wet-laid or dry-laid, and thereafter entangling the fibers by employing very fine water jets under high pressure. For example, a plurality of rows of waterjets is directed towards the fiber web which is disposed on a moving support, such as a wire (mesh). Hydroentangling of the fibers provides distinct hydroemboss patterns, which can create low fiber count zones, facilitate water dispersion, and provide a three dimensional structure. The entangled web is then dried.

A nonwoven fiber web of brightened fibers can be wet-laid or foam-formed in the presence of a dispersion agent. The dispersion agent can either be directly added to the fibers in the form of a so-called "fiber finish" or it can be added to the water system in a wet-laying or foam-forming process. The addition of a suitable dispersion agent assists in providing a good formation, i.e, substantially uniform fiber dispersion, of brightend fibers. The dispersion agent can be of many different types which provide a suitable dispersion effect on the brightened fibers or any mixture of such brightened fibers. A non-limiting example of a dispersion agent is a mixture of 75% bis(hydrogeneratedtallowalkyl) dimethyl ammonium chloride and 25% propyleneglycol. The addition ought to be within the range of 0.01-0.1 weight %.

During foam-forming the fibers are dispersed in a foamed liquid containing a foam-forming surfactant and water, whereafter the fiber dispersion is dewatered on a support, e.g., a wire (mesh), in the same way as with wet-laying. After the fiber web is formed, the fiber web is subjected to hydroentanglement with an energy flux of about 23,000 foot-pounds per square inch per second or higher. The hydroentanglement is carried out using conventional techniques and with equipment supplied by machine manufacturers. After hydroentanglement, the material is pressed and dried and, optionally, wound onto a roll. The ready material is then converted in a known way to a suitable format and is packed.

The nonwoven fabric of the present invention can be incorporated into a laminate comprising the nonwoven fabric and a film. Laminates can be used in a wide variety of applications, such outer-covers for personal care products and absorbent articles, for example diapers, training paints, incontinence garments, feminine hygiene products, wound dressings, bandages, and the like.

To form a laminate, an adhesive is applied to a support surface of the nonwoven fabric or a surface of the film. Examples of suitable adhesives include sprayable latex, polyalphaolefin, (commercially available as Rextac 2730 and Rextac 2723 from Huntsman Polymers, Houston, Tex.), and ethylene vinyl acetate. Additional commercially available adhesives include, but are not limited to, those available from Bostik Findley, Inc., Wauwatosa, Wis. Then, a film is fed onto the forming wire on top of the nonwoven fabric. Before application to the nonwoven fabric, the film is stretched as desired. The nonwoven fabric and film are combined and compressed in a nip to form the laminate. Although not required for pressure sensitive adhesives, the nip can be maintained at a desired adhesive bonding temperature suitable for the adhesive employed, e.g. heat activated adhesions. The laminate can be cut, directed to a winder, or directed to further processing.

In addition to applying a film to the nonwoven fabric, another fabric can be bonded to the nonwoven fabric, which can be, for example another nonwoven fabric or a woven fabric. The nonwoven fabric can be a nonwoven fabric made in accordance with the present invention. An adhesive can be applied to either the nonwoven fabric or the another fabric before nipping to form the laminate.

The films used in laminates can include, but are not limited to, polyethylene polymers, polyethylene copolymers, polypropylene polymers, polypropylene copolymers, polyurethane polymers, polyurethane copolymers, styrene-butadiene copolymers, or linear low density polyethylene. Optionally, a breathable film, e.g. a film comprising calcium carbonate, can be employed to form the laminate. Generally, a film is "breathable" if it has a water vapor transmission rate of at least 100 grams/square meter/24 hours, which can be measured, for example, by the test method described in U.S. Pat. No. 5,695,868, which is incorporated herein in its entirety by reference. Breathable films, however, are not limited to films comprising calcium carbonate. Breathable films can include any filler. As used herein, "filler" is meant to include particulates and other forms of materials which will not chemically interfere with or adversely affect the film, but will be substantially uniformly dispersed throughout the film. Generally, fillers are in particulate form and spherical in shape, with average diameters in the range between about 0.1 micrometers to about 7 micrometers. Fillers include, but are not limited to, organic and inorganic fillers.

Optionally, the brightening agent or the fiber mixture includes additives. Suitable additives include, but are not limited to, chelants, magnesium sulfate, surfactants, wetting agents, pH buffering agents, stabilizing additives, or any combination thereof.

The optional one or more additives can be present in a range between about 0.5 and about 5 wt. % based on the total weight of the mixture of non-wood fibers. In another aspect, one or more additives can be present in a range between about 1 and about 10 wt. %. Yet, in another aspect, one or more additives can be present in a range between about 2 and about 6 wt. %. Still yet, in another aspect, one or additives can be present in a range between about 3 and about 5 wt. %. In one aspect, the mixture of non-wood fibers can include one or more additives about or in any range between about 0.1, 0.2, 0.5, 0.7, 1, 2, 3, 4, 5, 6, 7, 8, 9, 10, 11, 12, 13, 14, 15, 16, 17, 18, 19, and 20 wt. %.

Suitable chelants include any metal sequestrant. Non-limiting examples of chelants include ethylenediamine-N, N'-disuccinic acid (EDDS) or the alkali metal, alkaline earth metal, ammonium, or substituted ammonium salts thereof, or mixtures thereof. Suitable EDDS compounds include the free acid form and the sodium or magnesium salt thereof. Examples of sodium salts of EDDS include $Na_2$EDDS and $Na_4$EDDS. Examples of such magnesium salts of EDDS include MgEDDS and $Mg_2$EDDS. Other chelants include the organic phosphonates, including amino alkylene poly (alkylene phosphonate), alkali metal ethane-1-hydroxy diphosphonates, nitrile-trimethylene phosphonates, ethylene diamine tetra methylene phosphonates, and diethylene triamine penta methylene phosphonates. The phosphonate compounds can be present either in their acid form or as a complex of either an alkali or alkaline metal ion, the molar ratio of the metal ion to phosphonate compound being at least 1:1. Other suitable chelants include amino polycarboxylate chelants such as EDTA.

Suitable wetting agents and/or cleaning agents include, but are not limited to, detergents and nonionic, amphoteric, and anionic surfactants, including amino acid-based surfactants. Amino acid-based surfactant systems, such as those derived from amino acids L-glutamic acid and other natural fatty acids, offer pH compatibility to human skin and good cleansing power, while being relatively safe and providing improved tactile and moisturization properties compared to other anionic surfactants.

Suitable buffering systems include any agents buffering agents that assist the buffering system in reducing pH changes. Illustrative classes of buffering agents include, but are not limited to, a salt of a Group IA metal including, for example, a bicarbonate salt of a Group IA metal, a carbonate salt of a Group IA metal, an alkaline or alkali earth metal buffering agent, an aluminum buffering agent, a calcium buffering agent, a sodium buffering agent, a magnesium buffering agent, or any combination thereof. Suitable buffering agents include carbonates, phosphates, bicarbonates, citrates, borates, acetates, phthalates, tartrates, succinates of any of the foregoing, for example sodium or potassium phosphate, citrate, borate, acetate, bicarbonate and carbonate, or any combination thereof. Non-limiting examples of suitable buffering agents include aluminum-magnesium hydroxide, aluminum glycinate, calcium acetate, calcium bicarbonate, calcium borate, calcium carbonate, calcium citrate, calcium gluconate, calcium glycerophosphate, calcium hydroxide, calcium lactate, calcium phthalate, calcium phosphate, calcium succinate, calcium tartrate, dibasic sodium phosphate, dipotassium hydrogen phosphate, dipotassium phosphate, disodium hydrogen phosphate, disodium succinate, dry aluminum hydroxide gel, magnesium acetate, magnesium aluminate, magnesium borate, magnesium bicarbonate, magnesium carbonate, magnesium citrate, magnesium gluconate, magnesium hydroxide, magnesium lactate, magnesium metasilicate aluminate, magnesium oxide, magnesium phthalate, magnesium phosphate, magnesium silicate, magnesium succinate, magnesium tartrate, potassium acetate, potassium carbonate, potassium bicarbonate, potassium borate, potassium citrate, potassium metaphosphate, potassium phthalate, potassium phosphate, potassium polyphosphate, potassium pyrophosphate, potassium succinate, potassium tartrate, sodium acetate, sodium bicarbonate, sodium borate, sodium carbonate, sodium citrate, sodium gluconate, sodium hydrogen phosphate, sodium hydroxide, sodium lactate, sodium phthalate, sodium phosphate, sodium polyphosphate, sodium pyrophosphate, sodium sesquicarbonate, sodium succinate, sodium tartrate, sodium tripolyphosphate, synthetic hydrotalcite, tetrapotassium pyrophosphate, tetrasodium pyrophosphate, tripotassium phosphate, trisodium phosphate, trometarnol, or any combination thereof.

Optionally, one or more stabilizing additives can be added during the bleaching or brightening process to prevent hydrogen peroxide decomposition. Non-limiting examples of suitable stabilizing additives include sodium silicate, magnesium sulfate, diethylene triamine penta acetic acid (DTPA), DTPA salts, ethylene diamine tetra acetic acid (EDTA), EDTA salts, or any combination thereof.

The brightened fibers of the present invention can be used for any paper or tissue product, including but not limited to, tissue products made in a wet laid paper machine. In one aspect, a tissue or a paper comprises non-wood fibers having a brightness greater than about 65 as measured by MacBeth UV-C standard.

The tissue paper can include any additional papermaking fibers, thermoplastic fibers, and/or synthetic fibers, and produced according to the Conventional Wet Press (CWP) manufacturing method, or by the Through Air Drying (TAD) manufacturing method, or any alternative manufacturing method (e.g., Advanced Tissue Molding System ATMOS of the company Voith, or Energy Efficient Technologically Advanced Drying eTAD of the company Georgia-Pacific). The web can be dried on a Yankee dryer and can be creped or un-creped.

The tissue or paper can include any amount of the brightened fibers disclosed herein. For example, tissues and papers can include about or in any range between about 5, 10, 15, 20, 25, 30, 25, 40, 45, 50, 55, 60, 65, 70, 75, 80, 85, 90, 95, and 100 wt. % of the brightened fibers.

For example, conventional wet pressed tissues are prepared by first preparing and mixing the raw fiber material in a vat to produce a fiber slurry. Then, the fiber slurry is transferred through a centrifugal pump to a headbox. From the headbox, the fibrous mixture is deposited onto a moving foraminous wire, such as Fourdrinier wire, to form a nascent web. Water can drain through the wire by use of vacuum and/or drainage elements. The web can then be dried by any suitable methods, including, but not limited to, air-drying, through-air drying (TAD), or drying on a Yankee dryer. For drying on a Yankee dryer, first an adhesive material is sprayed onto the surface of the Yankee dryer. The nascent web is transferred onto the hot Yankee dryer via one or two press rolls. The web is dried on the Yankee dryer and then removed with a creping doctor, which scrapes the web from the surface of the Yankee dryer drum. Then, the dried web is wound into a roll at the reel of the paper machine.

When used to form tissues or paper, the fiber slurry can include any additional additives known in the art, including, but not limited to, wet strength agents, debonders, surfactants, or any combination thereof.

EXAMPLES

In the following examples, flax fibers (commercially available from Crailar Technologies, Inc., Greensboro, N.C.) were used to assess the impact of oxygen during the bleaching process on shive content and brightness.

All brightness measurements were conducted on thick pads of flax fiber. The pads were generated by diluting a sample of the flax fibers to approximately 2% consistency with water. The flax samples were gently hand mixed to separate the fibers as much as possible and then dewatered on a Buchner funnel with a piece of filter paper to form the fiber pad. During dewatering, the flax fiber was manually distributed to form as uniform a pad as possible. Then the pad was removed from the Buchner funnel and pressed between blotters in a laboratory press machine for about 10 minutes under a maximum pressure of 3,000 PSI. The fiber pads were then dried on a speed dryer until substantially dry. Care was taken to avoid overheating the samples because any potential excess heat induced yellowing. The fiber pads were air-dried for several days prior to brightness testing. All brightness tests were conducted in accordance with the MacBeth UV-C test method.

Examples 1-9

Figure 12:
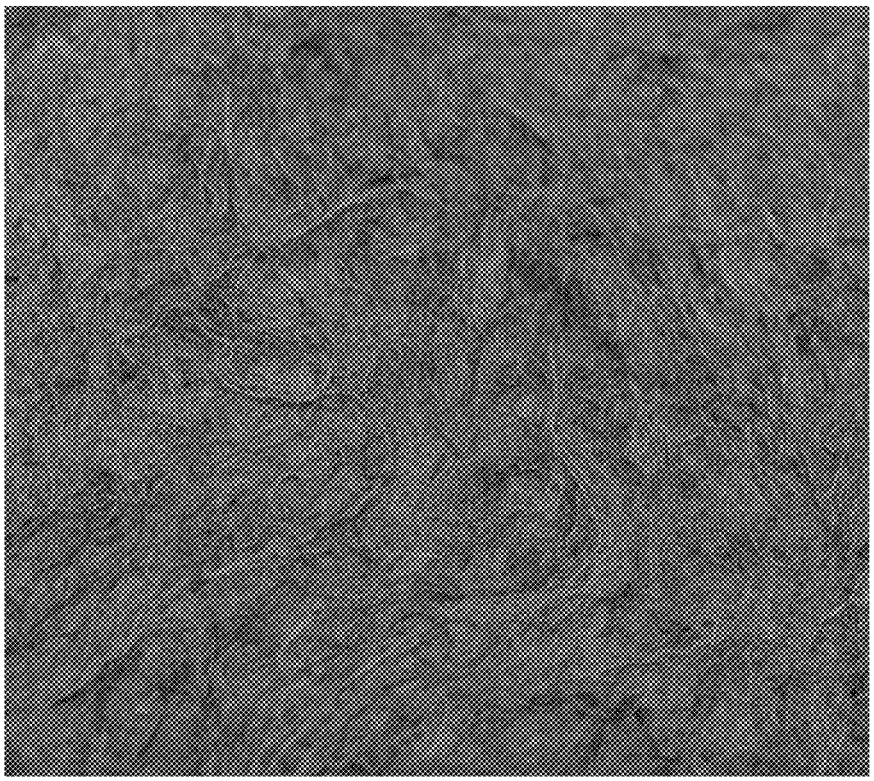
FIG. 12 is a photomicrograph of control flax fibers which were only chemically treated to remove pectin.

The initial starting (control) flax was commercially available "finished flax" from Crailar Technologies, Inc. These fibers were treated by the Crailar process, which included mechanical treatment, chemical treatment to remove pectin, hydrogen peroxide bleaching, and drying. As shown in Table 1 below (ID 1), these flax fibers demonstrated a MacBeth UV-C brightness of 57.8. FIG. 12 shows a photomicrograph of flax fibers, which have substantial shive content.

TABLE 1

Compositions and properties for Examples 1-9

| | Chemicals % OP | | | | | | Physical | | | | Brightness MacBeth UV-C | |
|---|---|---|---|---|---|---|---|---|---|---|---|---|
| ID | Peroxide | Caustic | Oxygen | TAED | DTPA | Silicate | Method | % TSS | Temp F. | Minutes | Brightness | Gain |
| 1 | Start Sample - "Bleached" | | | | | | | | | | 57.8 | |
| 2 | 1 | 1 | 0 | 0 | 0.1 | 0 | Bath | 12 | 190 | 120 | 76.4 | 18.6 |

TABLE 1-continued

Compositions and properties for Examples 1-9

| | Chemicals % OP | | | | | | Physical | | | | Brightness MacBeth UV-C | |
|---|---|---|---|---|---|---|---|---|---|---|---|---|
| ID | Peroxide | Caustic | Oxygen | TAED | DTPA | Silicate | Method | % TSS | Temp F. | Minutes | Brightness | Gain |
| 3 | 2 | 2 | 0 | 0 | 0.0 | 0 | Bath | 12 | 190 | 120 | 77.4 | 19.6 |
| 4 | 4 | 3 | 0 | 0 | 0.1 | 0 | Bath | 12 | 190 | 120 | 75.8 | 18.0 |
| 5 | 2 | 2 | 0 | 0 | 0.1 | 0.2 | Spinner | 8 | 190 | 120 | 76.8 | 19.0 |
| 6 | 4 | 2 | 0 | 0 | 0.1 | 0.2 | Spinner | 8 | 190 | 120 | 78.7 | 20.9 |
| 7 | 4 | 2 | 0 | 0.5 | 0.1 | 0.2 | Spinner | 8 | 190 | 120 | 79.7 | 21.9 |
| 8 | 3 | 1 | 1 | 0 | 0.0 | 0.2 | Q Mixer | 12 | 190 | 180 | 84.4 | 26.6 |
| 9 | 3 | 1 | 0 | 0 | 0.1 | 0.2 | Q Mixer | 12 | 190 | 180 | 78.6 | 20.8 |

DTPA = diethylene triamine pentaacetic acid, a chelant; Caustic = NaOH/sodium hydroxide; % TSS = percent Total suspended solids/consistency In Table 1, all the chemicals were % On Pulp (OP)= (weight of the chemical/weight of the fiber)*100. All chemicals were calculated on a 100% basis, i.e., the actual mass amount of the chemical and not the amount of a solution of the chemical. In Example 1, 30% hydrogen peroxide solution was used, but the data was recited in terms of 100% hydrogen peroxide.

In Examples 1-3, control flax fibers (Example 1) were bleached using the "bag" or "bath" method. Flax samples were placed in a zip lock style plastic bag and maintained at a constant temperature in a water bath for the bleaching process duration. Thirty oven dry (OD) grams of fiber were diluted to a 12% consistency using distilled water including the respective chemicals (see Table 1). Additional mixing was performed at 30 minute intervals for the remaining retention time. The samples were then removed from the water bath, and brightness pads of fibers were prepared as detailed above. As shown in Table 1, brightness gain ranged between about 18.0 and 19.6 according to the MacBeth UV-C standard test.

Another method of bleaching at a lower consistency (8%), a modified "spinner" method, was used in Examples 5-7. In this method, 30 g OD fiber was added to a 4 L beaker. Distilled water and the indicated chemicals were added to bring the pulp to an 8% consistency. The beakers were then placed in a 190° F. water bath about 80% submerged. Instead of continuously agitating the fibers with a motorized spinner, the samples were manually mixed (using a spoon) at approximately 10 minute intervals throughout the 180 minute duration of bleaching. A small amount of sodium silicate, 0.2 wt. % on pulp, was also added to the samples to help stabilize hydrogen peroxide.

Examples 5 and 6 mirror the chemical application of Examples 3 and 4 and demonstrated a 19.0 and 20.9 brightness gain, respectively. However, there was no significant difference in brightness gain between the bag and spinner bleaching. Sodium silicate also did not have any significant impact on the results.

Example 7 used the same initial charge of Example 6 (also a modified spinner method). This sample was allowed to peroxide bleach for 90 minutes, and then a sample equal to 0.5 wt. % of TAED granules was added to the pulp. The TAED was added to react with residual hydrogen peroxide and sodium hydroxide to form peracetic acid in situ. The addition of TAED resulted in a 1.0 higher brightness gain compared to the baseline peroxide bleach.

Figure 10:
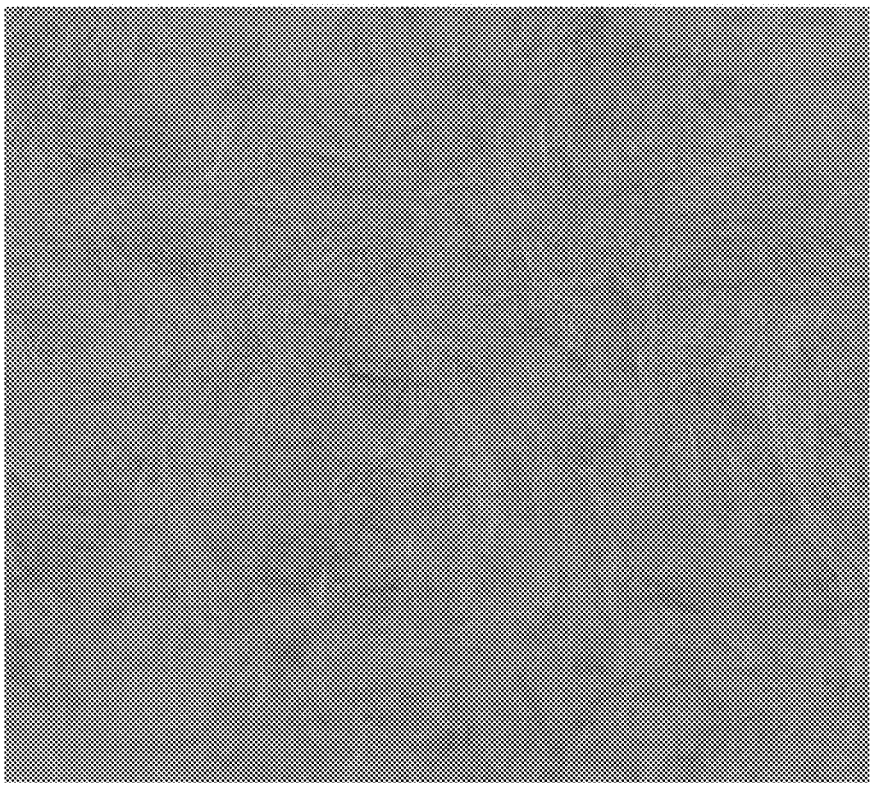
FIG. 10 is a photomicrograph of the flax fibers of FIG. 9 after brightening using a quantum mixer and a peroxide bleaching composition.
Figure 11:
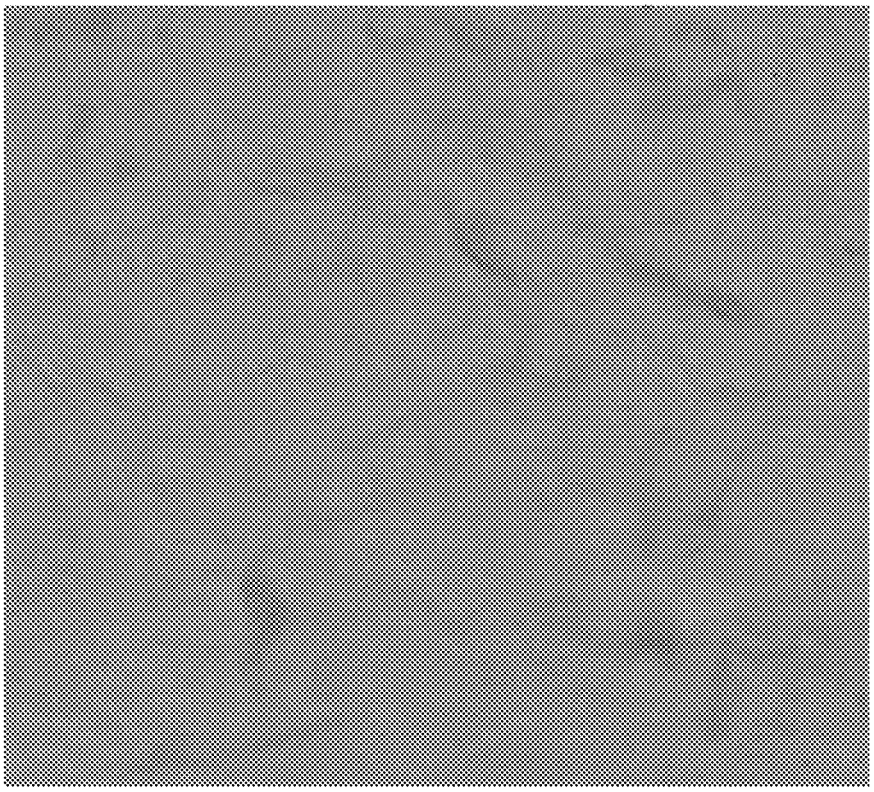
FIG. 11 is a photomicrograph of the flax fibers of FIG. 9 after bleaching using a quantum mixer and dissolved oxygen.

In Example 8-9, a Quantum Mixer Mark III (Quantum Technologies, Akron, Ohio) was used to test the addition of oxygen gas to the peroxide bleach. The mixer was a variable speed, high intensity mixer suitable for all bleaching stages, which allowed the pulp and chemical to react under controlled conditions of time, temperature and agitation with constant pH read out. The mixer was run with the lowest possible level of mixing to minimize fiber tangling in the final pulp mass. Examples 8 and 9 compare brightness results with and without oxygen. Example 9 was run without oxygen and achieved a 20.8 brightness gain, which is comparable to the 19.0 and 20.9 gain for the spinner bleaches in Examples 5 and 6. Example 8 was run with oxygen addition for the first 60 minutes of the bleach. The mixer bowel was pressurized to 60 psig pressure with oxygen at the start of the bleach. After 15 minutes, the pressure was relieved and a second 60 psig charge was added. After 60 minutes, the oxygen was vented, and the remaining 120 minutes of the retention was performed at atmospheric pressure. This sample achieved a 26.6 brightness gain for a 84.4 final brightness. Compared to Example 9, the oxygen increased the brightness gain by 5.8. In addition, visual examination of the handsheets showed a decreased visible shive content in the oxygen Example 8 (see FIG. 11) compared the non-oxygen Example 9 (see FIG. 10).

Example 10-17

In Examples 10-17 shown in Table 2, bleaching was performed in the Quantum mixer to assess the impacts of oxygen and TAED on brightness, as well as the effect of reductive bleaching. All experiments were performed on a de-pectinified, unbleached flax sample (Example 10). This control sample had a lower brightness, 27.9 and a higher level of shive contamination (see also FIG. 12 of Example 24 below).

TABLE 2

Compositions and properties for Examples 10-17

| | Start | Chemicals % OP | | | | | | | Physical | | | | Brightness MacBeth UV-C | |
|---|---|---|---|---|---|---|---|---|---|---|---|---|---|---|
| ID | Sample | Peroxide | Caustic | Oxygen | TAED | DTPA | Silicate | Hydrosulfate | Method | % TSS | Temp F. | Minutes | Brightness | Gain |
| 10 | Unbleached | | | | | | | | | | | | 27.9 | |
| 11 | 10 | 4 | 1.5 | 1 | | 0.1 | 0.5 | | Mixer | 15 | 190 | 120 | 64.0 | 36.1 |
| 12 | 11 | 3 | 1.5 | | | | | | Mixer | 15 | 180 | 120 | 82.6 | 54.7 |
| 13 | 10 | 4 | 1.5 | 1 | 0.5 | 0.1 | | | Mixer | 15 | 190 | 180 | 64.1 | 36.2 |
| 14 | Unbleached | 3 | 1.5 | 1 | | 0.1 | 0.5 | 0.5 | Mixer | 15 | 190 | 180 | 83.6 | 55.7 |
| 15 | Unbleached | 3 | 1.5 | 1 | | 0.1 | 0.5 | 1 | Mixer | 15 | 190 | 180 | 81.8 | 53.9 |
| 16 | Unbleached | 3 | 1.5 | 1 | | 0.1 | 0.5 | 1.5 | Mixer | 15 | 190 | 180 | 82.2 | 54.3 |
| 17 | 1 | 2 | 1 | 1 | | 0.1 | 0.5 | | Mixer | 15 | 190 | 180 | 83.9 | 26.1 |

Figure 13:
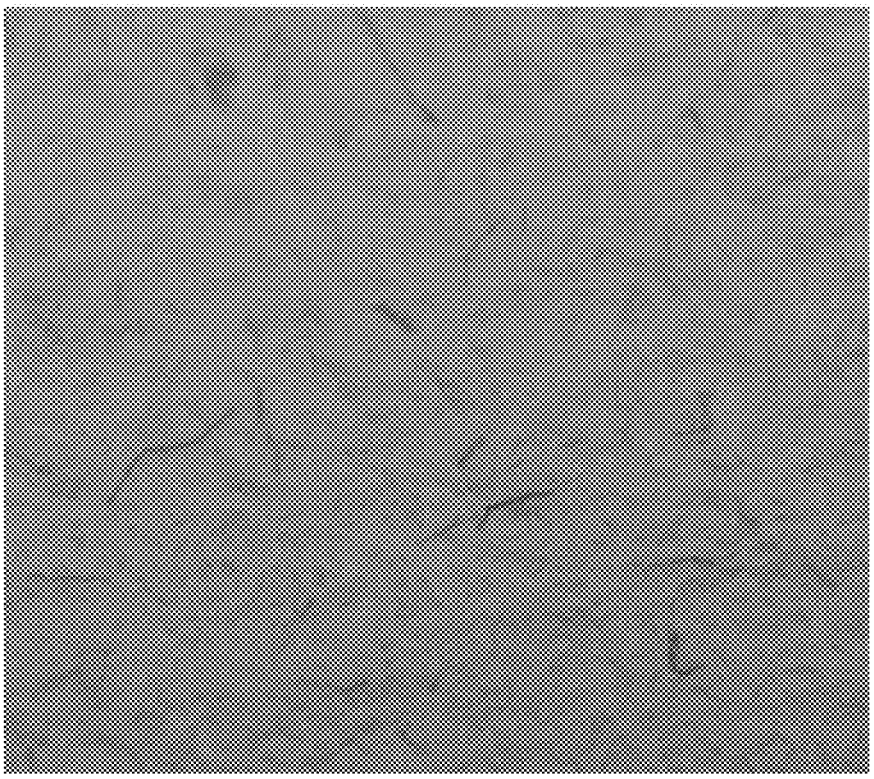
FIG. 13 is a photomicrograph of the flax fibers of FIG. 12 after bleaching using a quantum mixer and dissolved oxygen.

Example 11 utilized oxygen in the initial peroxide stage and demonstrated a 64.0 brightness after 120 minutes of retention (the first 60 minutes with oxygen as detailed above). As shown in FIG. 13, the fiber brightness pad demonstrated that the sample contained long, dark fibers which have a different appearance than the shives seen in the non-oxygen samples. Sample 11 was then washed on a Buchner funnel using the procedure detailed above, returned to the mixer, and then bleached with a hydrogen peroxide bleaching mixture. The final brightness after the second stage of bleaching was 82.6 (Example 12), compared to the final brightness of about 68 for the two-stage peroxide bleaching without oxygen (see Table 4). The fiber pad also showed a significant reduction in the long, dark fiber content and a very low level of shive.

Example 13 was performed similar to Example 11, except that a quantity of TAED equal to about 0.5 wt. % on pulp was added after 60 minutes (after the oxygen was vented). The TAED was added to form peracetic acid in situ from the residual peroxide and caustic. After an additional 60 minutes of retention, the brightness was measured and found to be 64.1.

Examples 14-16 were performed to assess the impact of reductive bleaching on an oxygen-treated sample. The flax fibers were peroxide bleached in the Quantum mixer analogously to Example 11, except with a lower peroxide charge (3% versus 4%). The pulp was removed from the mixer, washed on a Buchner funnel and then split into three portions. Each of the samples was reductively bleached using a sodium hydrosulfite and the bag method. For the reductive stage of bleaching, a 20 g OD portion of the pulp was diluted to 8% consistency with distilled water and placed in a zip-lock type bag. The samples were then placed in a sealed glove box, and nitrogen was used to purge the oxygen. Nitrogen was purged into the box for approximately 15 minutes. While under nitrogen purge, the specified sodium hydrosulfite charge was prepared by weighing the required hydrosulfite powder, adding 25 mL of distilled water to dissolve the powder, and then adding the composition to the flax sample. The bags were sealed and hand kneaded to mix the sodium hydrosulfite. The sealed bags were then removed from the glove box and placed in a 180° F. water bath for 60 minutes. Then, the bags were removed from the bath and a brightness pad was prepared for each sample.

The final brightness for these samples was between 81.8 and 83.6, which is comparable to a 82.6 brightness for the two-stage peroxide bleach Example 12. Table 4 below provides the brightness and color data for these samples. As indicated, the hydrosulfite bleached pulps (Examples 14-16) had less color than Example 12 (A* and B*).

The MacBeth meter measures both TAPPI brightness and LAB whiteness. L* is the whiteness, and a* and b* are the color (red-green and blue-yellow). A* and b* values close to 0 indicate very low color/no color. The b* values shown in Table 3 are important because indicate a reduction in the yellow color of the fiber. Natural flax fiber is very yellow and thus not desirable in a wiper or tissue product. UV-C is the "C" illuminate, including the ultraviolet component of the light. "UV Excl" is UV excluded and does not include the ultraviolet light. The UV-C with UV may provide the most realistic conditions under which consumers perceive non-wovens.

TABLE 3

Brightness and color results for Examples 10-17

| ID | Brtness UV Excl. MacBeth % | Color MB UV Excl. A* Unitless | Color MB LW Excl. B* Unitless | Color MB UV Excl. L* Unitless | Brtness MacBeth UV-C % | Color MacBeth L*UV C Unitless | Color MacBeth a*-UV C Unitless | Color MacBeth b*-UV C Unitless | Whtness MacBeth UV-C |
|---|---|---|---|---|---|---|---|---|---|
| 10 | 28.8 | 0.9 | 8.7 | 65.5 | 27.9 | 64.6 | 1.0 | 8.5 | −20.5 |
| 11 | 65.3 | −1.0 | 10.3 | 90.4 | 64.0 | 89.7 | −1.1 | 10.2 | 25.8 |
| 12 | 82.5 | −1.0 | 5.4 | 95.8 | 82.6 | 95.7 | −1.1 | 5.3 | 65.0 |
| 13 | 63.8 | −1.2 | 10.5 | 89.7 | 64.1 | 90.1 | −1.1 | 11.0 | 23.4 |
| 14 | 83.7 | −0.8 | 4.7 | 95.9 | 83.6 | 95.8 | −0.7 | 4.6 | 68.6 |
| 15 | 82.9 | −0.7 | 4.8 | 95.6 | 81.8 | 95.4 | −0.9 | 5.3 | 64.0 |
| 16 | 82.4 | −0.8 | 5.0 | 95.4 | 82.2 | 95.2 | −0.7 | 4.7 | 66.3 |
| 17 | 83.7 | −0.8 | 4.4 | 95.7 | 83.9 | 95.8 | −0.9 | 4.4 | 69.4 |

Examples 18-24

In Examples 18-24 (see Table 4), one and two-stage peroxide bleach processes, without oxygen, were performed on de-pectinified, unbleached flax (Example 24). FIG. 12 shows a photomicrograph of the fibers in Example 24 (brightness of 57.8), which demonstrates the higher level of shive contamination.

TABLE 4

Compositions and properties for Examples 18-24

| | | Chemicals % OP | | | | Physical | | | | Brightness MacBeth UV-C | | |
|---|---|---|---|---|---|---|---|---|---|---|---|---|
| ID | Stage | Peroxide | Caustic | DTPA | Silicate | Method | % TSS | Temp F. | Minutes | Brightness | Stage Gain | Total Gain |
| 24 | | Start Sample - "Unbleached" | | | | | | | | 28.5 | | |
| 18 | 1 | 2 | 1 | 0.1 | 0.05 | Spinner | 8 | 190 | 180 | 60.2 | 31.7 | |
| 19 | 2 | 3 | 1 | | 0.05 | Spinner | 8 | 190 | 120 | 68.2 | 8.0 | 39.7 |
| 20 | 1 | 3 | 1 | 0.1 | 0.05 | Spinner | 8 | 190 | 180 | 59.2 | 30.7 | |
| 21 | 2 | 3 | 1 | | 0.05 | Spinner | 8 | 190 | 120 | 67.5 | 8.3 | 39.0 |
| 22 | 1 | 6 | 2 | 0.1 | 0.05 | Spinner | 8 | 190 | 180 | 60.0 | 31.5 | |
| 23 | 2 | 3 | 1 | | 0.05 | Spinner | 8 | 190 | 120 | 68.1 | 8.1 | 39.6 |

The modified "spinner" method was used for the bleaches. After the first bleaching stage, the sample was diluted to approximately 2 L with distilled water and de-watered on a Buchner funnel. Two 1 L rinses were added to the de-watered pulp in the Buchner funnel to remove any residual chemical. The pulp was then split and one part used to make a pad for brightness testing. The remaining pulp was then bleached in the spinner method for a second peroxide stage. Finally, the brightness pad was made from the pulp after the second bleaching stage was complete.

Example 1, the Crailar bleached flax (commercial bleaching process by unknown bleaching methods), had a brightness of 57.8. In comparison, Examples 18, 20, and 22 were single stage peroxide bleached flax, which achieved brightness between 59.2 and 60.2. The flat brightness response was independent of the amount of peroxide used.

Each of the pulps was then second stage bleached as described above (Examples 19, 21, and 23). An additional 8.0 to 8.3 brightness gain was seen in the second stage to provide a final brightness between 67.5 and 68.3. Again, there was no difference in brightness attributable to peroxide dose.

Examples 25-28

To determine the impact of reducing agents on the fiber without prior oxygen treatment, a set of experiments was performed on the unbleached (Example 10) and bleached (Example 1) flax samples at neutral and acidic pH. Table 5 shows the brightness gains and optical data for Examples 25-28.

TABLE 5

Brightness gains and optical data

| | Start | Hydrosulfite | | Physical | | | | MacBeth UV-C | | | | |
|---|---|---|---|---|---|---|---|---|---|---|---|---|
| ID | Sample | pH | % OP | Method | % TSS | Temp F. | Minutes | Brightness | Gain | L* | A* | B* |
| 1 | Initial | | | | | | | 59.1 | | 87.34 | −0.16 | 10.75 |
| 25 | Bleached | 7.03 | 1 | Bag | 8 | 180 | 60 | 61.1 | 2.0 | 87.5 | −0.4 | 9.16 |
| 26 | Bleached | 3.36 | 1 | Bag | 8 | 180 | 60 | 61.0 | 2.0 | 87.54 | −0.57 | 9.29 |
| 10 | Initial | | | | | | | 30.0 | | 66.24 | 1.03 | 8.12 |
| 27 | Unbleached | 8.06 | 1 | Bag | 8 | 180 | 60 | 31.3 | 1.3 | 67.13 | 0.51 | 7.85 |
| 28 | Unbleached | 8.06 | 1 | Bag | 8 | 180 | 60 | 30.2 | 0.1 | 66.45 | 0.68 | 8.34 |

As shown in Table 5, single stage hydrosulfite bleaching on both samples only showed up to 2 points of brightness gain and a slight reduction in color. When this result is compared to the reductive bleaching of oxygen-treated flax (Examples 14-16), it is evident that oxygen-treated flax demonstrates a 15 to 20 point brightness gain. Without being bound by theory, oxygen may be acting as an activating agent to enhance the performance of a subsequent reductive bleaching stage.

During hand-mixing of the samples (15 minute intervals during the 60 minute retention), the unbleached samples unexpectedly increased in brightness during visual observation. The lower pH sample demonstrated the largest change and had a light tan color, compared to the starting grey color. However, soon after the fiber was exposed to air, the color reverted back to the dark grey color, resulting in only a slight improvement in brightness over the starting sample. The bleached flax sample may also have displayed similar reversion, although, due to the higher initial brightness, it was difficult to be sure how much reversion was actually observed. This reversion was not observed in the oxygen treated samples.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A method comprising:

forming non-wood fibers into fiber mat at consistency of about 20% to about 50%, the non-wood fibers having a mean length of about 5 to about 95 millimeters (mm); and exposing the fiber mat at the consistency of about 20% to about 50% to a brightening agent to produce brightened fibers, the brightening agent comprising a peroxide compound and oxygen gas, the oxygen gas being dissolved in solution and being about 0.1 to about 10.0% on fiber oxygen;

wherein the brightened fibers have a brightness greater than the non-wood fibers before exposure as measured by a TAPPI brightness test method; and wherein the non-wood fibers are bast fibers.

2. The method of claim 1, wherein the non-wood fibers are flax fibers, hemp fillers, jute fibers, ramie fibers, nettle fibers, Spanish broom fibers, kenaf plant fibers, or any combination thereof.

3. The method of claim 1, wherein the brightening agent further comprises an alkaline compound.

4. The method of claim 1, wherein the peroxide compound is hydrogen peroxide, sodium peroxide, or both hydrogen peroxide and sodium peroxide.

5. The method of claim 3, wherein the alkaline compound is sodium hydroxide, potassium hydroxide, calcium hydroxide, monoethanolamine, ammonia, or any combination thereof.

6. The method of claim 3, wherein the brightening agent has an initial pH in a range between about 9.5 and about 10.5.

7. The method of claim 1, further comprising exposing the brightened fibers to at least a second brightening agent comprising peracetic acid.

8. The method of claim 1, further comprising a second brightening agent, the second brightening agent being a peroxide compound, an alkaline compound, a reducing agent, or any combination thereof.

9. The method of claim 8, wherein the reducing agent is sodium hydrosulfite, potassium hydrosulfite, sodium sulfite, potassium sulfite, sodium bisulfite, potassium bisulfite, sodium metasulfite, potassium metasulfite, sodium borohydride, or any combination thereof.

10. The method of claim 1, wherein the fiber mat is exposed to the brightening agent for a time in a range between about 5 and about 60 minutes.

11. The method of claim 1, further comprising adding tetra acetyl ethylene diamine to the brightening agent or the mixture.

12. The method of claim 1, further comprising adding magnesium sulfate to the brightening agent or the mixture.

13. The method of claim 1, wherein the brightening agent further comprises a stabilizing additive.

14. The method of claim 13, wherein the stabilizing additive is a chelant, a pH buffering compound, or any combination thereof.

15. The method of claim 1, wherein the brightening agent further comprises a surfactant, a wetting agent, or a combination thereof.

16. The method of claim 1, further comprising forming a nonwoven fabric comprising the brightened fibers.

17. The method of claim 16, wherein the nonwoven fabric is a wet wipe, a dry wipe, or an impregnated wipe.

18. The method of claim 17, wherein the nonwoven fabric is a tissue, a facial tissue, a bath tissue, a baby wipe, a personal care wipe, a personal protective wipe, a cosmetic wipe, a perinea wipe, a disposable washcloth, a kitchen wipe, an automotive wipe, a bath wipe, a hard surface wipe, a cleaning wipe, a disinfecting wipe, a glass wipe, a mirror wipe, a leather wipe, an electronics wipe, a lens wipe, a polishing wipe, a medical cleaning wipe, or a disinfecting wipe.

19. The method of claim 1, further comprising carding the brightened fibers to form a nonwoven fabric.

20. The method of claim 1, further comprising hydrogen-tangling the brightened fibers to form a nonwoven fabric.

21. The method of claim 1, further comprising spunbonding the brightened fibers to form a nonwoven fabric.

22. The method of claim 1, wherein the mixture of fiber mat of non-wood fibers are exposed to the brightening agent in a kier.

23. A method comprising:

forming non-wood fibers into fiber mat at consistency of about 20% to about 50%, the non-wood fibers having a mean length of about 5 to about 95 mm; and exposing the fiber mat at the consistency of about 20% to about 50% to a brightening agent to produce low-shire fibers, the brightening agent comprising a peroxide compound and oxygen gas, the oxygen gas being dissolved in solution and being about 0.1 to about 10.0% on fiber oxygen;

wherein the low-shine fibers have less visible shive content than the non-wood fibers before exposure; and wherein the non-wood fibers are bast fibers.

24. The method of claim 22, wherein the kier has an external circulation system.

25. The method of claim 1, further comprising introducing a gas into a chamber comprising the brightened fibers after exposing the non-wood fibers to the brightening agent to displace residual brightening agent.

26. The method of claim 1, further comprising forming a tissue or a paper comprising the brightened fibers.

27. The method of claim 1, wherein the oxygen gas is dissolved and maintained under an oxygen partial pressure in a range between about 0.5 and about 10 Bar.

28. A method comprising:

forming of non-wood fibers into fiber mat at consistency of about 20% to about 50%, the fibers having a mean length of about 5 to about 95 mm; and exposing the fiber mat at the consistency of about 20% to about 50% to a brightening agent to produce low-shive fibers, the brightening agent comprising a peroxide compound and oxygen gas, the oxygen gas being dissolved in solution and being about 0.1 to about 10.0% on fiber oxygen;

wherein the low-shive fibers have less visible shive content than the fibers of the mixture before exposure.

29. The method of claim 28, wherein the brightening agent further comprises an alkaline compound.

30. The method of claim 28, wherein the peroxide compound is hydrogen peroxide, sodium peroxide, or both hydrogen peroxide and sodium peroxide.

31. The method of claim 29, wherein the alkaline compound is sodium hydroxide, potassium hydroxide, calcium hydroxide, monoethanolamine, ammonia, or any combination thereof.

32. The method of claim 28, wherein the brightening agent has an initial pH in a range between about 9.5 and about 10.5.

33. The method of claim 28, further comprising exposing the brightened fibers to at least a second brightening agent comprising peracetic acid.

34. The method of claim 28, further comprising exposing the brightened fibers to a second brightening agent, the second brightening agent being a peroxide compound, an alkaline compound, a reducing agent, or any combination thereof.

35. The method of claim 34, wherein the reducing agent is sodium hydrosulfite, potassium hydrosulfite, sodium sulfite, potassium sulfite, sodium bisulfite, potassium bisulfite, sodium metasulfite, potassium metasulfite, sodium borohydride, or any combination thereof.

36. The method of claim 28, wherein the fiber mat is exposed to the brightening agent for a time in a range between about 5 and about 60 minutes.

37. The method of claim 28, further comprising adding tetra acetyl ethylene diamine to the brightening agent or the mixture.

38. The method of claim 28, further comprising adding magnesium sulfate to the brightening agent or the mixture.

39. The method of claim 28, wherein the oxygen gas is dissolved and maintained under a partial oxygen pressure in a range between about 0.5 and about 10 Bar.

40. The method of claim 28, wherein the non-wood fibers have a consistency in a range between about 5% and about 50%.

41. The method of claim 28, wherein the brightening agent further comprises a stabilizing additive.

42. The method of claim 41, wherein the stabilizing additive is a chelant, a pH buffering compound, or any combination thereof.

43. The method of claim 28, further comprising forming a nonwoven fabric comprising the brightened fibers.

44. The method of claim 28, wherein the fiber mat of non-wood fibers are exposed to the brightening agent in a kier.

45. The method of claim 44, wherein the kier has an internal circulation system.

46. The method of claim 44, wherein the kier has an external circulation system.

47. The method of claim 28, further comprising introducing a gas into a chamber comprising the brightened fibers after exposing the non-wood fibers to the brightening agent to displace residual brightening agent.

48. The method of claim 28, further comprising forming a tissue or a paper comprising the brightened fibers.

* * * * *